US006460456B1

(12) United States Patent
Sugiyama et al.

(10) Patent No.: US 6,460,456 B1
(45) Date of Patent: Oct. 8, 2002

(54) STAMP MAKING APPARATUS AND ATTACHMENT THEREOF

(75) Inventors: Koji Sugiyama; Naohito Asai, both of Nagoya; Tetsuji Fuwa, Hashima; Teruo Imamaki, Nisshim; Takashi Okumura, Nagoya; Takashi Miki, Nagoya; Teruyo Katsuno, Nagoya, all of (JP)

(73) Assignee: Brother Kogo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/533,929

(22) Filed: Mar. 23, 2000

(30) Foreign Application Priority Data

Mar. 31, 1999 (JP) ..... 11-093103
Sep. 13, 1999 (JP) ..... 11-258195

(51) Int. Cl.[7] ..... B41K 1/02; B41K 1/50
(52) U.S. Cl. ..... 101/327; 101/407.1; 101/401.1
(58) Field of Search ..... 101/127, 103, 101/109, 112, 327, 333, 407.1, 401.1

(56) References Cited

U.S. PATENT DOCUMENTS 5,915,299 A * 6/1999 Kuriyama et al. ..... 101/128.1
5,957,053 A * 9/1999 Hayama ..... 101/401.1

FOREIGN PATENT DOCUMENTS

| | | | |
|---|---|---|---|
| EP | 798114 A2 | * | 10/1997 |
| EP | 0 798 114 A2 | | 10/1997 |
| JP | 8-300784 A | * | 11/1996 |
| JP | 9-309257 A | * | 12/1997 |
| JP | 11-78192 | | 3/1999 |
| JP | 11-277711 A | * | 10/1999 |
| WO | WO 96/22874 | | 8/1996 |

* cited by examiner

*Primary Examiner*—Daniel J. Colilla
(74) *Attorney, Agent, or Firm*—Oliff & Berridge PLC

(57) ABSTRACT

A stamp making apparatus of the invention makes a stamp plate on a stamp material by applying light thereto through a draft sheet. The stamp making apparatus includes an attachment that can be attached to and removed from a predetermined position facing the draft sheet and has a mounting hole where a holder having a stamp material can be inserted into and removed from. A plurality of mounting holes are formed in the attachment so that the holders having various types and shapes can be inserted into and removed from directly or via an auxiliary attachment. Further, the attachment includes a first adjusting device, which moves the mounting hole in a longitudinal direction of the draft sheet (in the Y direction), and a second adjusting device, which moves the mounting hole in a lateral direction (in the X direction), so that the position of the mounting hole in the attachment can be finely adjusted.

35 Claims, 25 Drawing Sheets

STAMP MAKING APPARATUS AND ATTACHMENT THEREOF

BACKGROUND OF THE INVENTION

1. Field of Invention

The invention relates to a stamp making apparatus, in particular, a stamp making apparatus capable of being attached one or more holders having various types or shapes of stamp materials thereof and an attachment for holding such holders.

2. Description of Related Art

There have been various stamp making apparatuses capable of making a stamp easily. For example, a stamp making apparatus, which is disclosed in Japanese Laid-Open Patent Publication No. 11-78192, includes a printing portion, which prints an image on a draft sheet, an irradiation unit including a transparent plate and a light source, a pair of rollers, which feed the draft sheet on the transparent plate and a stamp setting unit, which presses the porous resin member against the draft sheet on the transparent plate.

In this case, a holder holding a stamp material at lower end portion thereof is set to a stamp making apparatus so that a positive copy and the stamp material face each other and the stamp material is pressed with an original film existing between the positive copy and the stamp material. When a xenon tube emits light under this condition, the stamp material is lit through the positive copy. Then, only the portion of the stamp material, which is lit through the transparent portion of the positive copy, is melted, and is solidified and sealed by the heat generated by the light absorption material. The sealed portion does not allow ink to pass through. On the other hand, the portion of the stamp material, which is neither melted nor solidified, remains as it is and forms characters, and the like. Therefore, the stamp plate having a stamp surface, which contains sealed (non-printed) and unsealed (printed) portions at the bottom surface of the stamp material, is made.

When stamp printing the image, such as characters, a skirt member of a stamp unit is placed at a desirable position on a printing paper and a grip member is pressed downward. Therefore, the holder moves downward within the skirt member, so that the stamp material is attached to the printing sheet by pressure. Printing, as characters, for example, is performed by adhering ink to the printing paper from the unsealed portion of the stamp surface of the stamp material.

The size (area) of the holder, and by extension, that of the stamp surface in the conventional stamp unit, are substantially the same as that of an image forming area of a draft sheet. Further, they have a substantially rectangular-shape when viewed from above, and their area size and shape (size) are one pattern.

However, though area and shape (size) of the stamp surface had been changed to meet the user's needs, these needs were not satisfied. For example, if a very small image area is needed for an image to be formed on the draft sheet, the draft sheet is discarded without using most of its area after stamp making. Thus, problems exist such that the draft sheet was wasted and which led to an increase in cost.

SUMMARY OF THE INVENTION

The invention provides a stamp making apparatus capable of making various types or shapes of stamps and an attachment used for making such stamps. The invention also provides a stamp making apparatus capable of finely adjusting the mounting position of a stamp material in a stamp making portion and an attachment used for such adjustment.

In this regard, the stamp making apparatus of an embodiment of the invention that applies an energy applying unit that applies an energy to the stamp material, including energy source, and an attachment that is detachably attached to the energy applying unit and that defines at least one positioning portion into which the stamp holder can be detachably inserted. The positioning portion positions the stamp holder for the stamp material to face the energy source. The stamp making apparatus preferably includes an attachment that defines a plurality of positioning portions.

According to the stamp making apparatus or the attachment structured as described above, stamp plates can be made on a plurality of stamp surfaces at the same time because one or more holders that are smaller than a normal size holder, can be inserted into one attachment. Further, when a transparent draft sheet is used for making a stamp, a stamp area of the transparent draft sheet can be used efficiently, and stamp plates can be easily made on a small size or various shaped holders.

In a preferred aspect of the invention, the stamp making apparatus further includes a detecting device that detects a type of the attachment. Preferably in the stamp making apparatus, the attachment includes a distinguishing portion detectable by the detecting device. The stamp making apparatus further preferably includes an energy controller that controls the energy applying unit based on a type of attachment detected by the detecting device.

According to the stamp making apparatus or the attachment structured as described above, it is unnecessary to perform an operation for inputting a type and shape of the holder to the stamp making apparatus every time, and the amount of energy to be applied can be easily adjusted in accordance with the size of the stamp surface.

In a preferred aspect of the invention, the attachment further includes a transparent supporting sheet which is attached to the bottom surface of the attachment.

According to the stamp making apparatus or the attachment structured as described above, as the transparent supporting sheet is attached to the bottom surface of the attachment in a tensioned state, the holder is prevented from accidentally falling from a mounting hole. Further, because the transparent supporting sheet is disposed between the bottom of the holder and the draft sheet, the transparent supporting film acts as a thermally insulating material, so that the transparent supporting film can prevent the transparent draft sheet from adhering to the stamp surface due to melting by heat energy from the light.

In a preferred aspect of the invention, the stamp making apparatus may further include an auxiliary member detachably inserted into the positioning portion of the attachment, and the auxiliary member defines an opening into which the stamp holder is inserted.

According to the stamp making apparatus or the attachment structured as described above, because the auxiliary member can be freely attached to and removed from the opening in the attachment, various types of holders can be inserted into the openings by changing the auxiliary member without increasing the number of attachments if the auxiliary member is made so that various types of small holders can be inserted thereinto. Therefore, the cost for manufacturing attachments can be reduced and the attachments can be stored without being bulky.

According to another aspect of the invention, the attachment may include an adhesive member at a bottom surface thereof, which adheres the transparent draft sheet to the attachment.

According to the stamp making apparatus or the attachment structured as described above, the stamp area of the transparent draft sheet can be easily adjusted so as to be positioned within the opening.

According to another aspect of the invention, the stamp making apparatus may further include a fine adjustment device that adjusts the position of the attachment relative to the energy applying unit in a horizontal direction.

According to the stamp material or the attachment structured as described above, a draft data area (stamp area) can be positioned within the stamp surface area in the holder even though the position of the draft data area (stamp area) is shifted due to an error of a printing position on the transparent draft sheet or the stop position of the transparent draft sheet is shifted after it is transported to the stamp making portion. Therefore, a misalignment can be reliably prevented.

According to another aspect of the invention, the fine adjustment device may include a first moving device that moves the attachment in a first horizontal direction. Preferably in the stamp making apparatus, the fine adjustment device may further include a second moving device that moves the attachment in a second horizontal direction perpendicular to the first horizontal direction.

According to the stamp making apparatus or the attachment structured as described above, the draft on the transparent draft sheet can be aligned with the opening by the first moving device and the second moving device even if the stamp material is tiny and a shift occurs between the stamp material and the draft on the transparent draft sheet. The opening is two-dimensionally moved relative to the transparent draft sheet by the first moving device that moves the opening in the longitudinal direction of the transparent draft sheet, and the second moving device that moves the opening in the lateral direction of the transparent draft sheet. Further, though there are various sizes and shapes of holders having stamp materials thereof, stamp plates can be formed on the stamp materials held by such holders if the attachment having an opening corresponding to such holders is set to a predetermined position in the stamp making apparatus.

In a preferred aspect of the invention, the stamp making apparatus may further include a feeding mechanism that feeds the transparent draft sheet to between the light source and the attachment. The fine adjustment device may include a feeding direction moving device that moves the attachment in a feeding direction of the transparent draft sheet. The stamp making apparatus preferably includes a lateral direction moving device that moves the attachment in a lateral direction perpendicular to the feeding direction of the transparent draft sheet.

According to the stamp making apparatus or the attachment structured as described above, the feeding direction moving device is slid in the longitudinal direction of an outer frame (feeding direction of the transparent draft sheet) and the lateral direction moving device is slid in the lateral direction of the feeding direction (in a direction perpendicular to the feeding direction of the transparent draft sheet). Therefore, the position of the opening can be two-dimensionally adjusted relative to the transparent draft sheet.

In a preferred aspect of the invention, the fine adjustment device may include an outer frame, a first slide member which is disposed in the outer frame and is capable of sliding in a first horizontal direction, a second slide member which is disposed in the first slide member and is capable of sliding in a second horizontal direction, a first adjustment device that adjusts the position of the first slide member relative to the outer frame, and a second adjustment device that adjusts the position of the second slide member relative to the first slide member. Preferably, the first adjusting device may include a first spring disposed on an end of the first slide member in a sliding direction thereof, a first cam disposed on the other end of the first slide member in the sliding direction thereof, and a first finger grip member connected to the cam. Preferably, the second adjusting device may include a second spring disposed on an end of the second slide member in a sliding direction thereof, a second cam disposed on the other end of the second slide member in the sliding direction thereof, and a second finger grip member connected to the cam.

According to the stamp making apparatus or the attachment structured as described above, the spring, which is disposed at one side of the moving direction of the slide member, urges the slide member, and the cam, which is disposed at other side of the moving direction, makes contact with the slide member, so that the position of the slide member is determined. When the cam is rotated using the finger grip member, the slide member moves in accordance with an eccentricity of a cam surface.

In a preferred aspect of the invention, a peripheral part around the positioning portion of the attachment is made of a transparent material.

According to the stamp making apparatus or the attachment structured as described above, the transparent draft sheet can be seen through the transparent material around the opening. Therefore, visual positioning can be easily made.

According to another aspect of the invention, the peripheral part around the positioning portion of the attachment may have a positioning mark thereon.

According to the stamp making apparatus or the attachment structured as described above, the position of the opening can be finely adjusted so that the positioning marks for positioning the transparent draft sheet seen through the transparent material around the opening are aligned with the positioning mark around the opening.

According to another aspect of the invention, a part of the attachment having the positioning mark thereon is formed into a convex lens.

According to the stamp making apparatus or the attachment structured as described above, positioning marks can be easily aligned because the positioning marks for positioning the draft sheet and the positioning mark around the opening are magnified through the convex lenses.

According to another aspect of the invention, the attachment has a fixing portion for fixing the transparent supporting sheet, the fixing portion is formed to asymmetrical about a center line thereof.

According to the stamp making apparatus or the attachment structured as described above, even though silicone is only applied to a stamp surface side of the transparent sheet, the side, to which is applied silicone, always faces the stamp material because insertion portions are asymmetrically formed.

BRIEF DESCRIPTION OF THE DRAWINGS

A preferred embodiment of the present invention will be described in detail with reference to the following figures wherein.

DETAILED DESCRIPTION OF PREFERRED EMBODIMENTS

Figure 1:
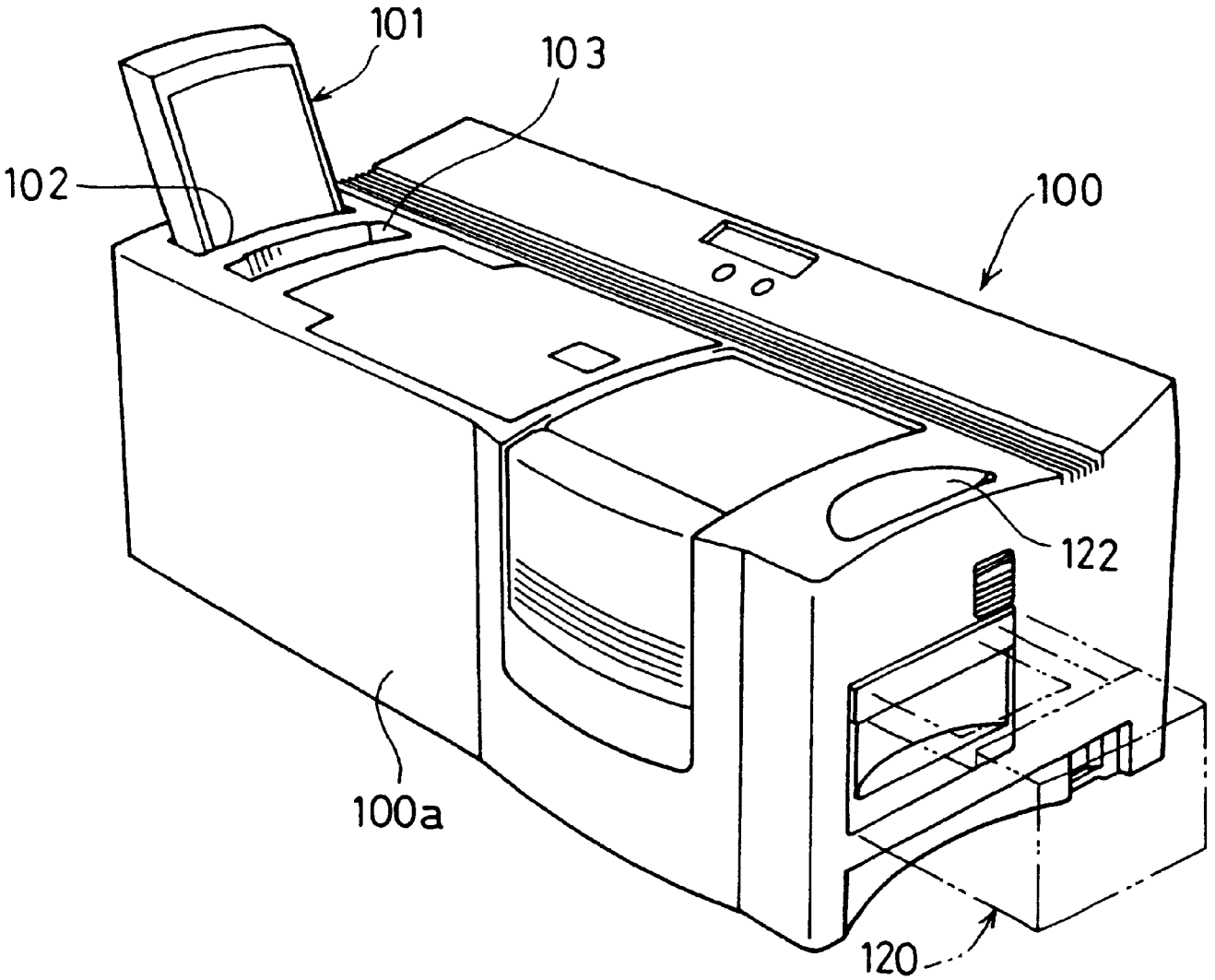
FIG. 1 is a general perspective view of a stamp making apparatus.
Figure 2:
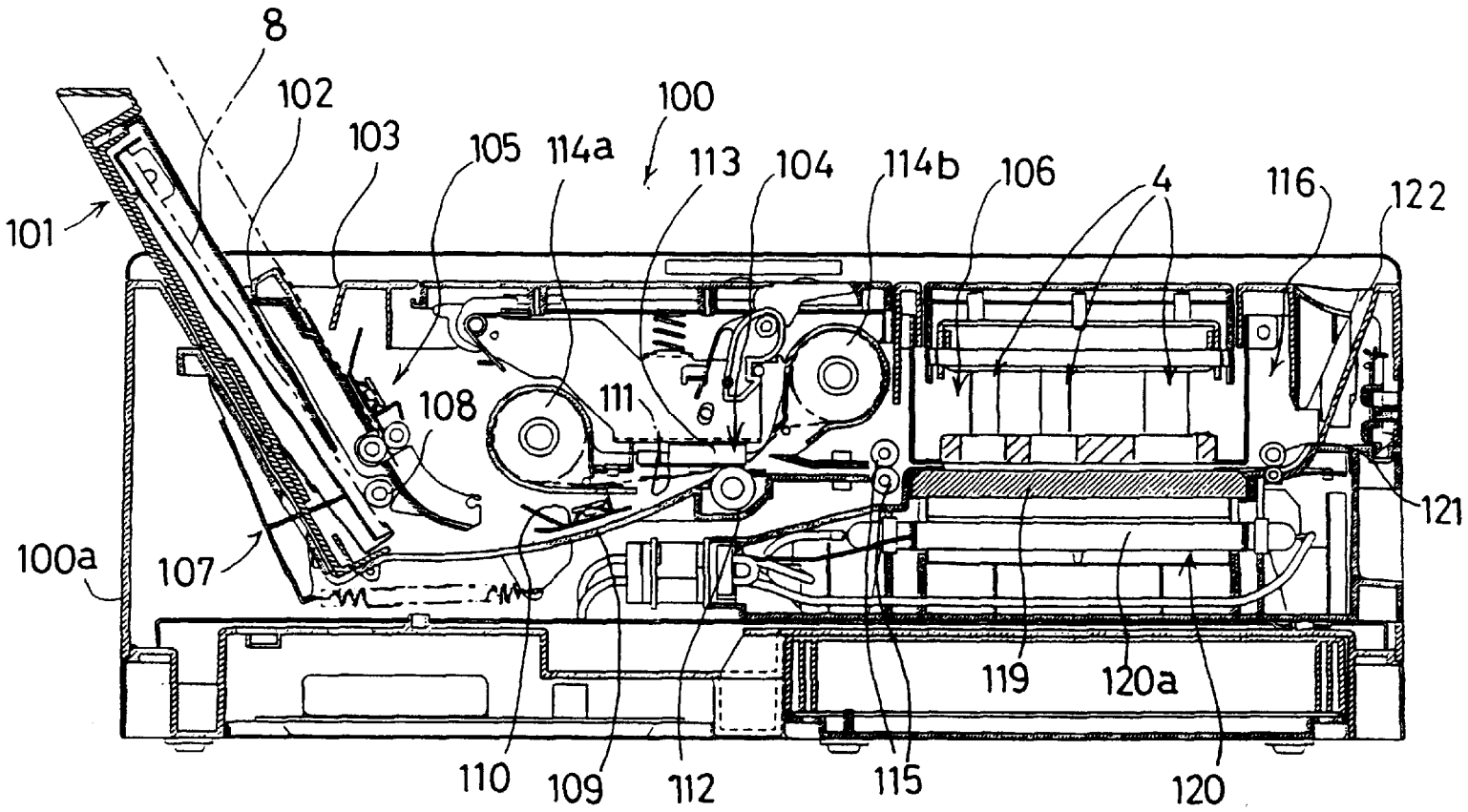
FIG. 2 is a sectional view of the stamp making apparatus.
Figure 3:
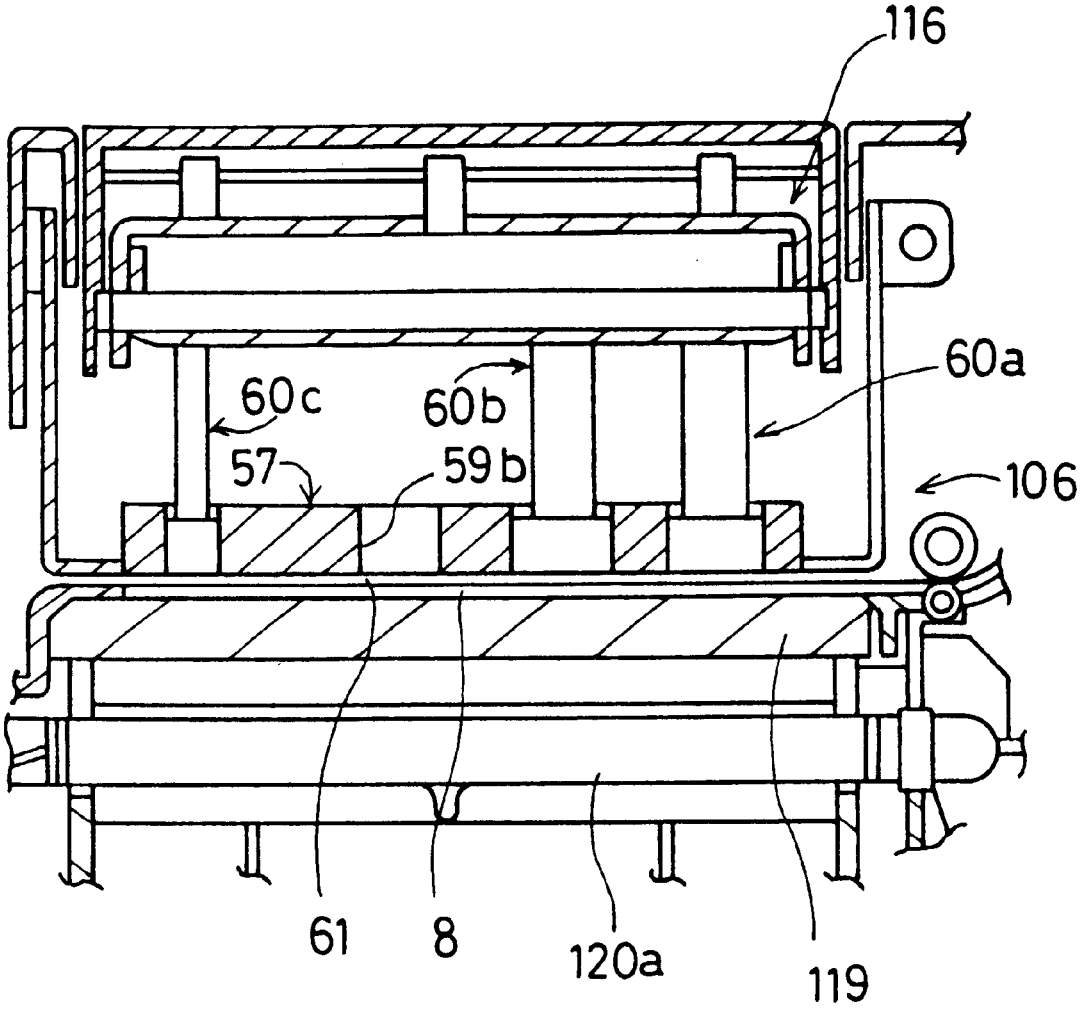
FIG. 3 is an enlarged sectional view of a stamp making portion.
Figure 4:
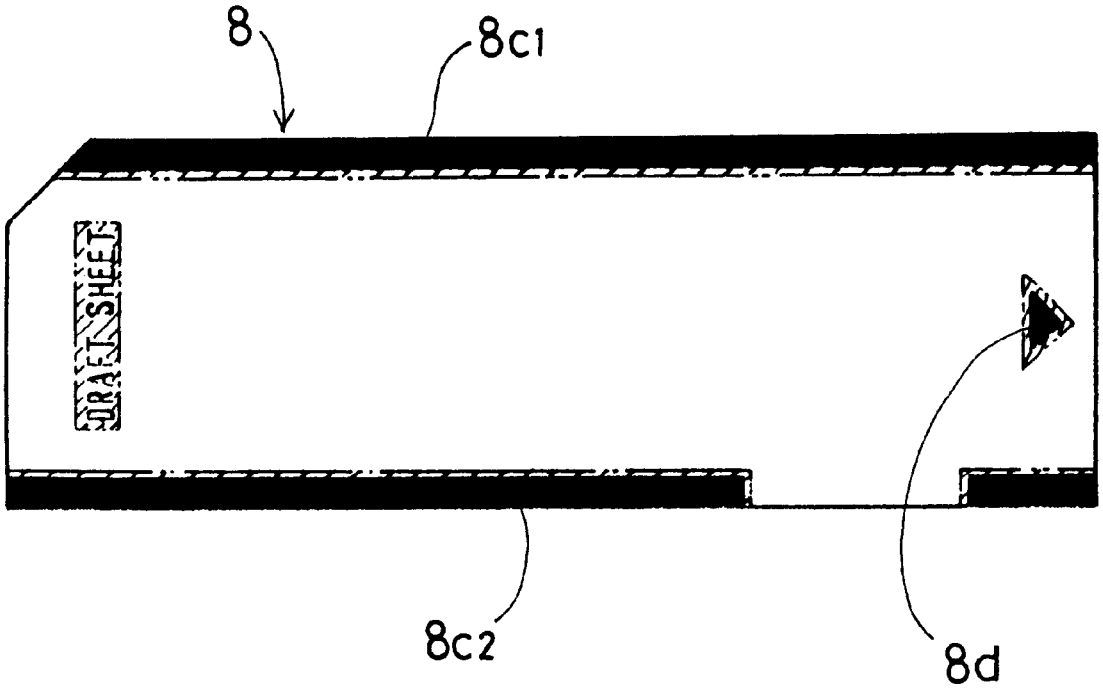
FIG. 4 is a plan view of draft sheet.
Figure 5:
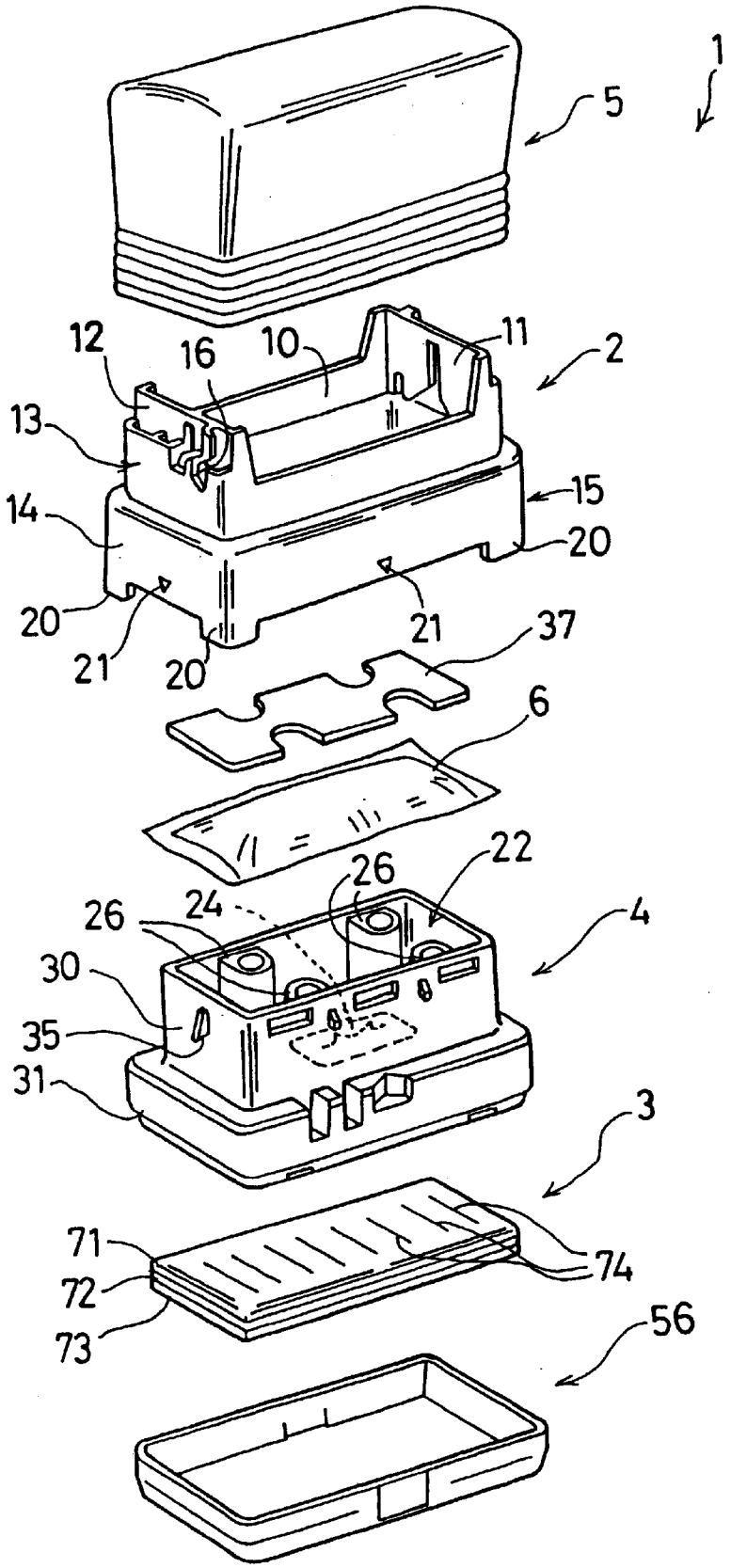
FIG. 5 is a perspective view of each part of a stamp unit.
Figure 6:
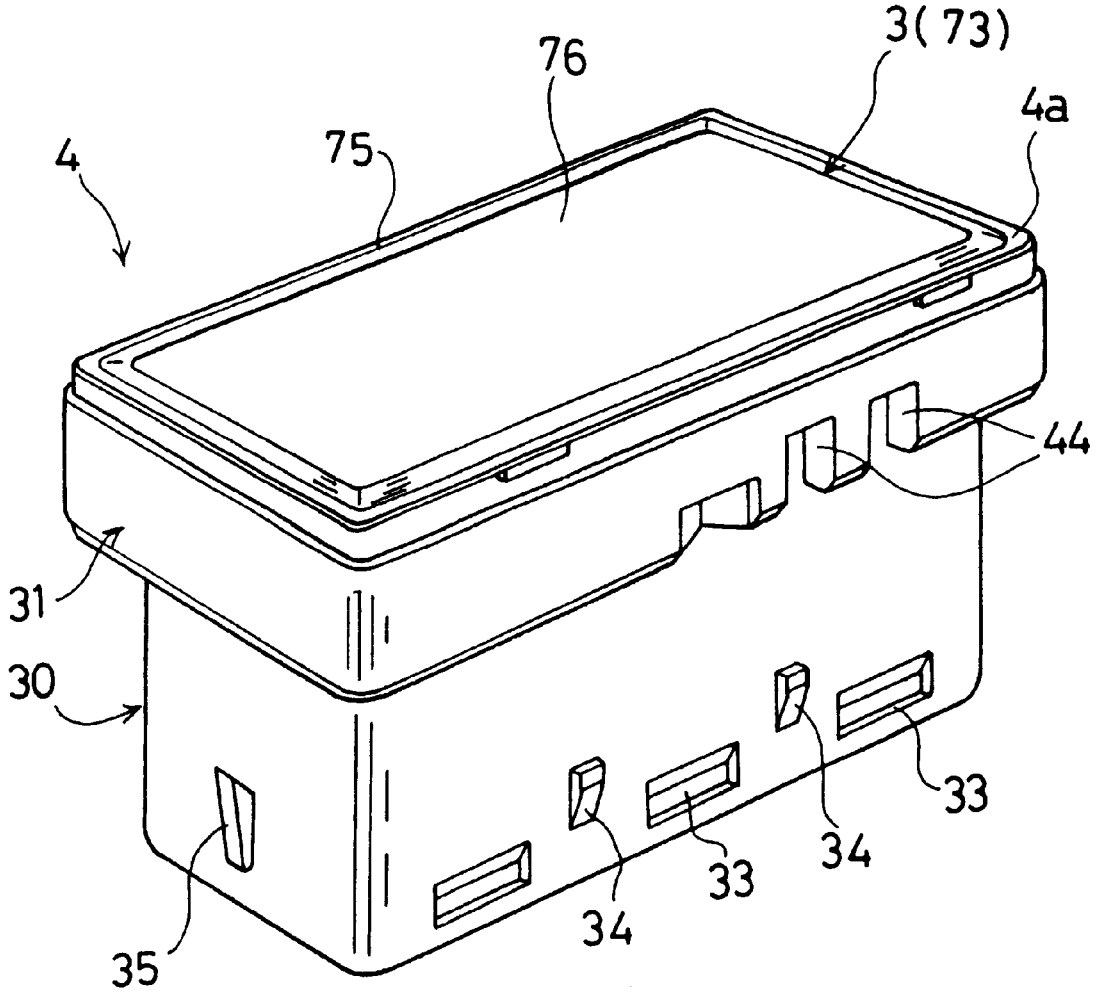
FIG. 6 is a perspective view of a holder when viewed from below.
Figure 7:
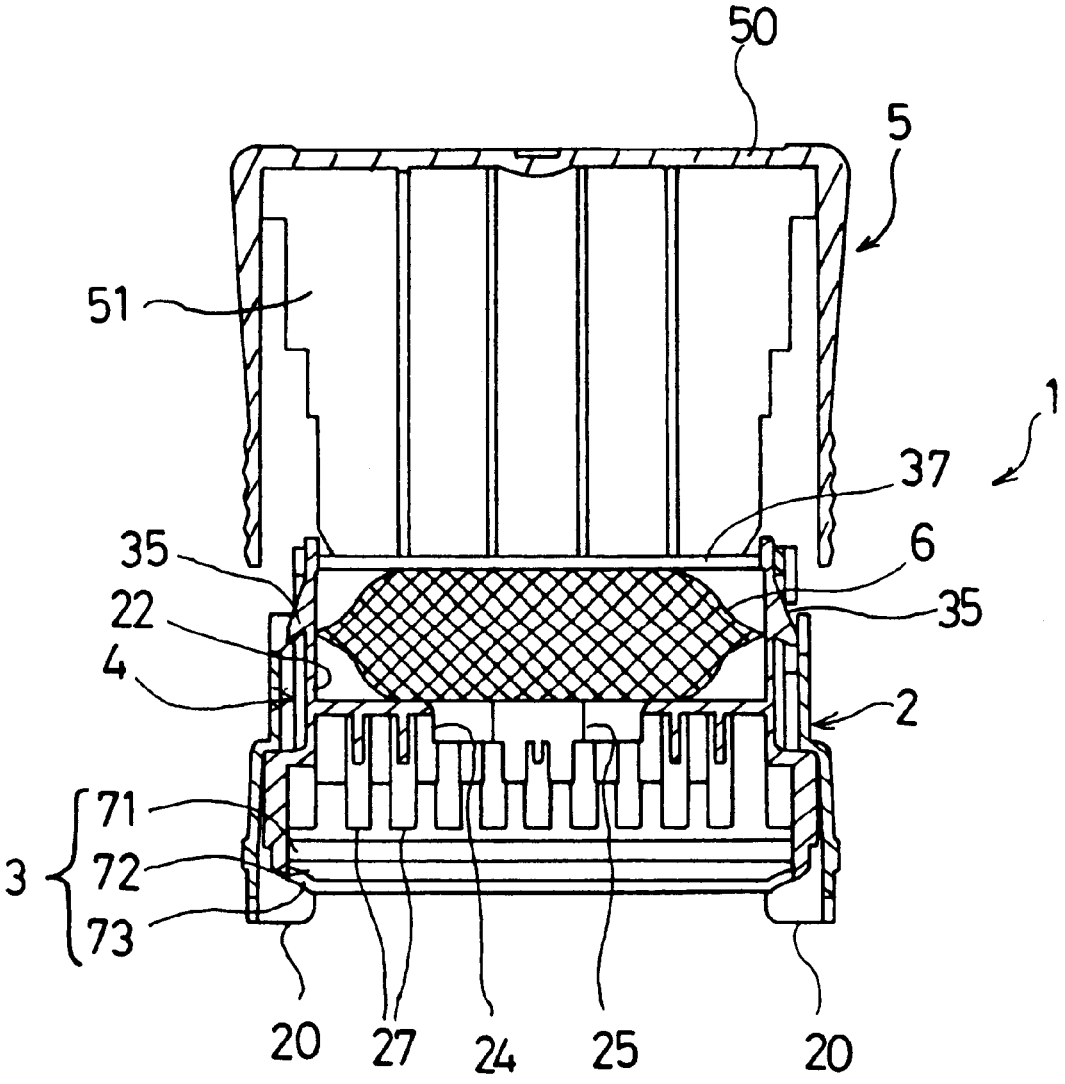
FIG. 7 is a sectional side view of the stamp unit before ink pack is cut and opened.
Figure 8:
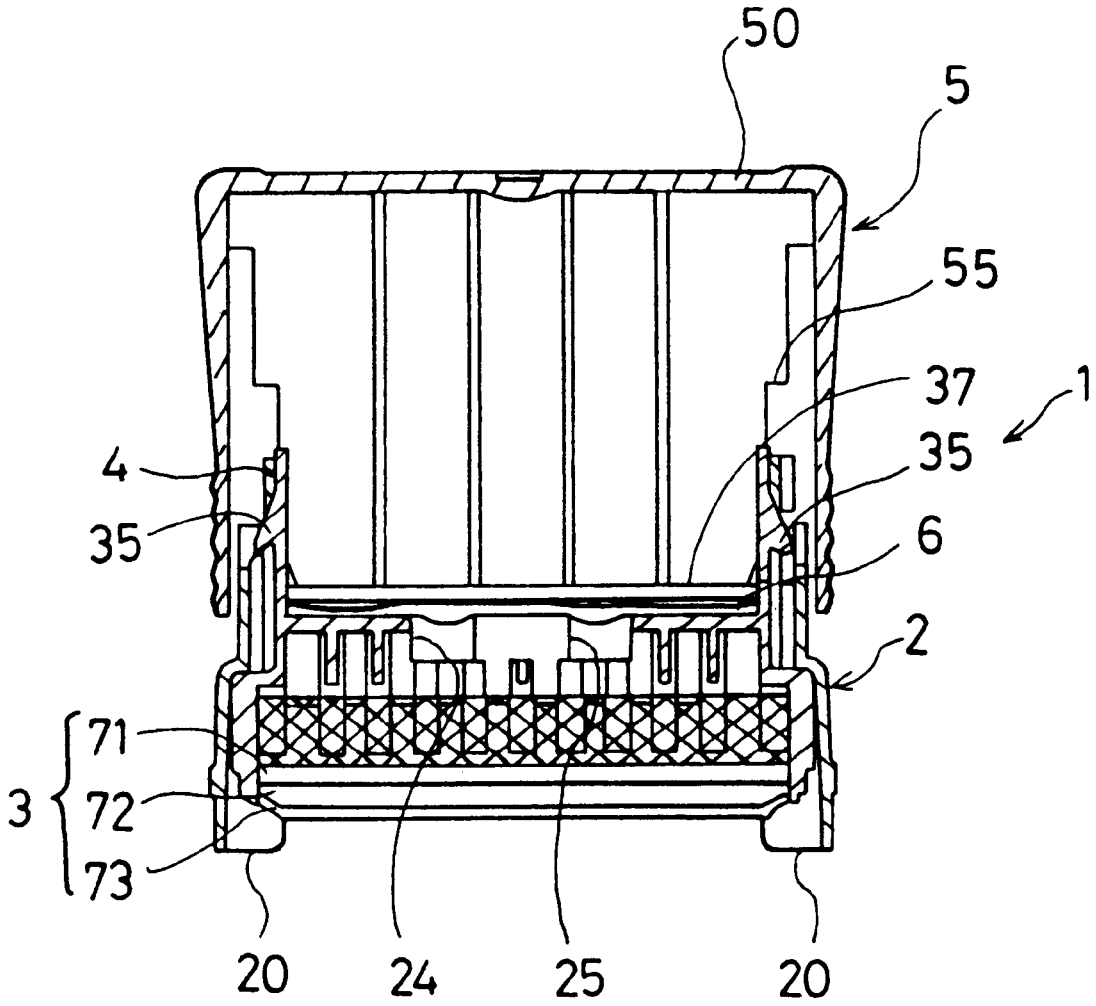
FIG. 8 is a side view of he stamp unit after ink pack is cut and opened.
Figure 9:
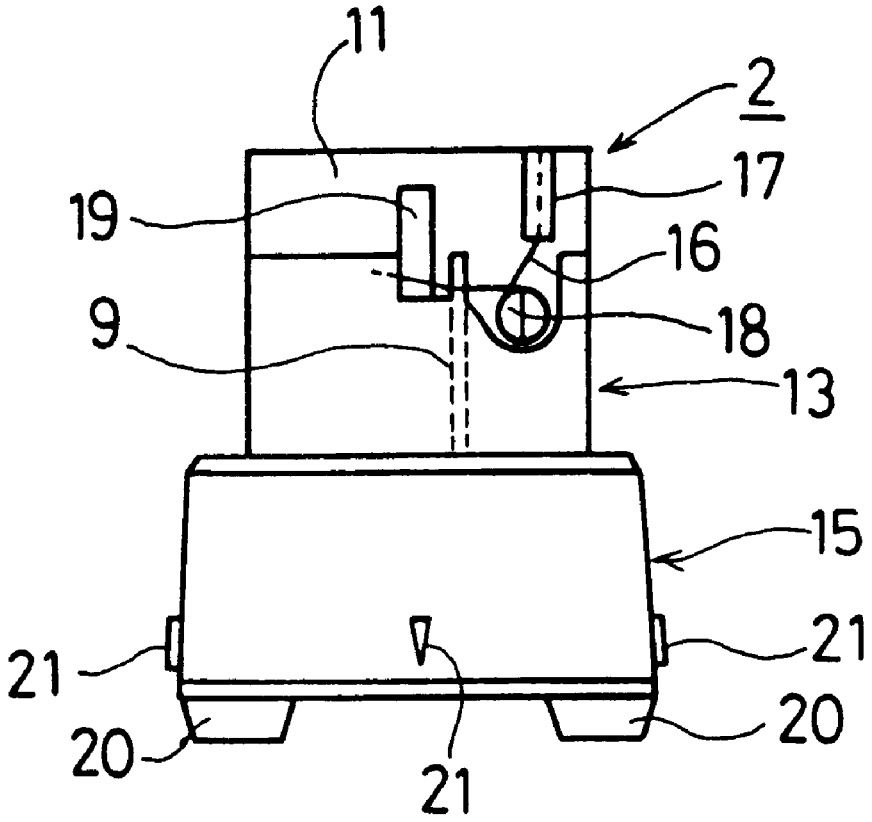
FIG. 9 is a sectional view of a skirt member.
Figure 14:
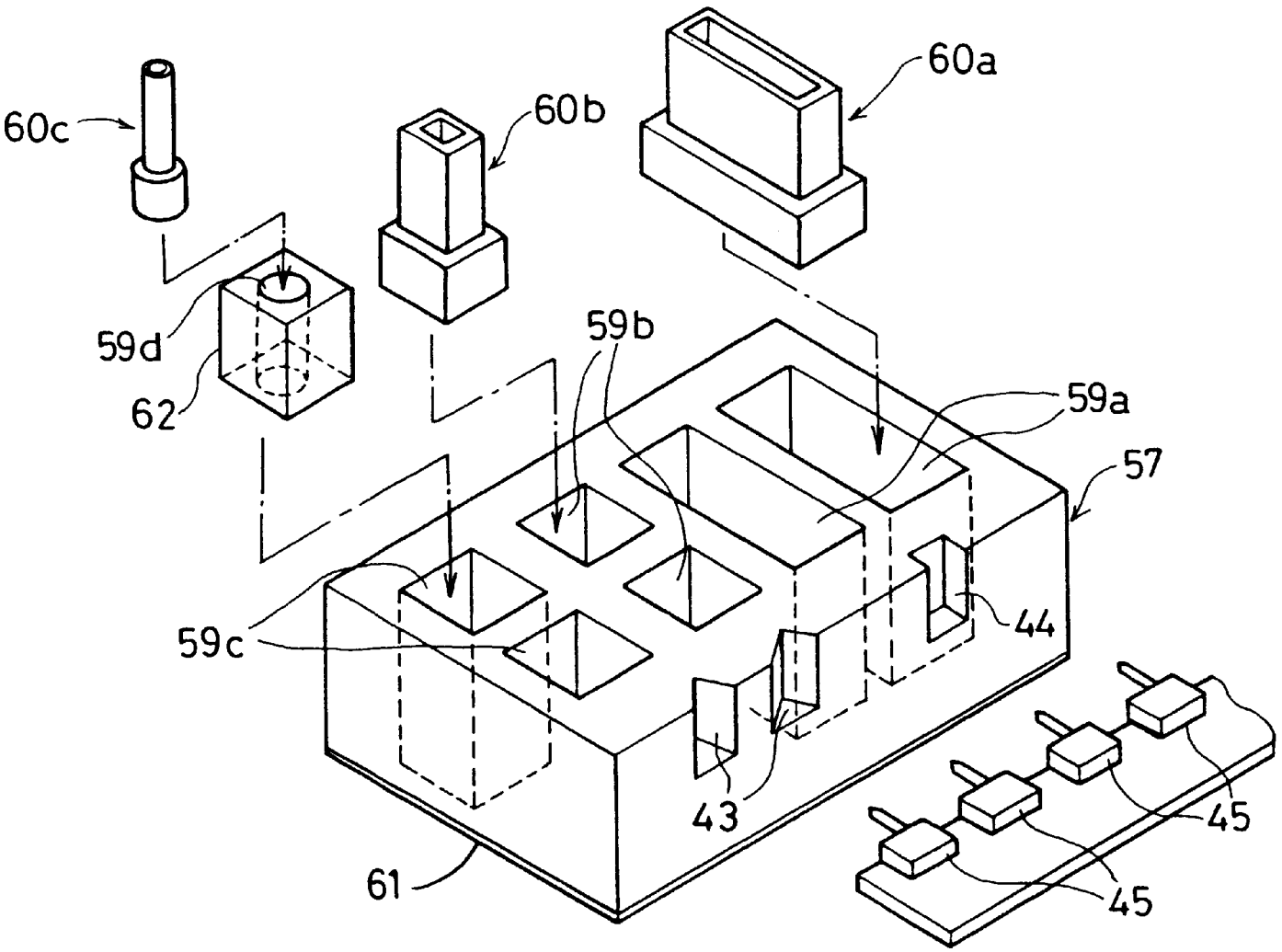
FIG. 14 is a perspective view of an attachment and an auxiliary attachment according to a first embodiment.

Embodiments of the present invention will be described with reference to the accompanying drawings. FIG. 1 is a general perspective view of a stamp making apparatus; FIG. 2 is a sectional view of the stamp making apparatus; FIG. 3 is an enlarged sectional view of a stamp making portion; FIG. 4 is a plan view of draft sheet; FIG. 5 is an exploded perspective view of a normal size stamp unit; FIG. 6 is a perspective view of a holder holding a stamp material when viewed from below; FIG. 7 is a sectional side view of the stamp unit before ink pack is cut and opened; FIG. 8 is a sectional side view of he stamp unit after ink pack is cut and opened; and FIG. 14 is a perspective view of an attachment.

As shown in FIGS. 1 and 2, a magazine mounting portion 102 is provided on upper portion of one side of a body case 100*a* made of such as synthetic resin in a stamp making apparatus 100. A cassette type magazine 101 storing a plurality of draft sheets 8, as cut sheets, can be attached to and removed from the magazine mounting portion 102. A manual sheet insertion portion 103, for manually feeding the draft sheet 8 one by one, is provided adjacent to the magazine mounting portion 102. In the case 100, a paper feeding portion 105 and a stamp making portion 106 are provided. The paper feeding portion 105 sends the draft sheet 8 one by one toward a printing portion 104. An irradiation unit 120 having a xenon lamp 120*a* for making a predetermined stamp surface on a stamp material 3 mounted on the bottom surface of a holder 4 in the stamp unit 1, can be attached to and removed from the stamp making portion 106.

In a pressing mechanism 107 pressing up from the bottom surface side of the magazine 101, the draft sheet 8 is pressed by a feed roller 108 in the paper feeding portion 105. The draft sheet 8 is fed from the magazine 102 by the feed roller 108, and then is passed between an ink ribbon 111 and a platen roller 112 in the printing portion 104 via between a guide plate 109 and an shift suppression auxiliary guide plate 110. While the draft sheet 8 is intermittently transported by the platen roller 112, a thermal head 113 is operated according to a printing data (draft data), such as characters and images, which are transmitted from an outside source, e.g., personal computer, and an image (including characters) to be stamped is printed on the surface of the draft sheet 8 made of transparent film such as polyethylene terephthalate. The ink ribbon 111 is taken up from a supply reel 114*a* to a take-up reel 114*b* via the thermal head 113 and the platen roller 112.

Then, the draft sheet 8 is sent to the stamp making portion 106 via a pair of rollers 115 disposed at a downstream transport guide portion. The stamp making portion 106, as shown in FIGS. 2 and 3, is structured with a stamp setting unit (a positioning mechanism) 116 and the irradiation unit 120. The holder 4 fixed the stamp material on its bottom surface, is caught in right/left and back/front directions and is set in the stamp making portion 106 by the positioning mechanism 116. The irradiation unit 120 can be inserted into and removed from a space under the lower position of the holder 4. In this case, a transparent plate 119, which is made of such as acrylic resin plate, is provided over the irradiation unit 120. A pressing device (not shown), which makes the stamp surface of the holder 4 pressed toward the draft sheet 8 positioned on the top surface of the transparent plate 119, is provided in the positioning mechanism 116. The draft sheet 8, on which an image is printed, is discharged from an outlet 122 to outside via a pair of discharge rollers 121 after stamp making process is completed.

Next, a structure of the draft sheet 8 will be described. As shown in FIG. 4, an image receiving layer is formed on an entire surface of one side of a base sheet (a thickness of the base sheet is 100 $\mu$m in this embodiment), which is a transparent synthetic resin film (e.g., polyethylene terephthalate) and has substantially rectangular shape when viewed from above. Further, stripe layers are formed along both side edges of the base sheet in a longitudinal direction of the base sheet by printing. The image receiving layer is formed so that ink is easy to apply to the draft sheet 8 by the ink ribbon 111 during printing in the printing portion 5. For example, since polyethylene terephthalate is outstanding for the chemical stability, cyclized rubber, shellac, rosin ester, cellulose derivative, or polyvinyl chloride acetate copolymer, or the like is applied onto the surface of the base sheet, as a solid binder, over an inorganic oxidizing agent. A mark 8*d* made of an ink layer, for indicating an inserting direction into the magazine 101, is provided on the front end of the right side of the draft sheet 8. The stripe layer 8*c*1, 8*c*2 on the both side edges of the draft sheet 8, are sensed by a sensor disposed in a transport path between the sheet feeding portion 105 and the printing portion 104, so that a beginning of a predetermined printing area of the draft sheet 8 is set under the platen roller 113. After that, printing is performed, and the draft sheet 8 is inherited to a pair of rollers 115, and then the draft sheet 8 is transported to the stamp making portion 106.

Next, a stamp unit according to the invention will be described. A normal size stamp unit 1, shown in FIGS. 5 through 8, has a rectangular-shaped stamp surface that corresponds to a stamp area of approximately 60 to 80% of the surface area of the draft sheet 8. Structures of stamp units having various stamp surfaces such as a smaller stamp surface (holder), or a circular or triangular stamp surface (holder) (described hereinafter) are the same as that of normal size stamp unit 1, so that explanation for those stamp units will be omitted.

The stamp unit 1 comprises a skirt member 2, which supports the stamp unit 1 during stamp printing; a holder 4, which is slidably disposed within the skirt member for movement in an up and down (axial) direction and which holds a stamp material 3 thermally and pressingly adhered to a lower end portion of the holder 4; a grip member 5, which is joined to the holder 4 and moves the holder 4 downward to press the stamp material 3 against a printing paper (not shown) during stamp printing; and a cap member 56, which protects the stamp material 3 on the holder when nonuse.

An ink pack storing portion 22 of the holder 4 can store a bag-shaped ink pack 6, which is filled with ink and is made from a film material. The ink pack 6 is filled with ink that quantity is substantially the same as ink in which the stamp material 3 can store. A thick paper plate 37 is arranged between the ink pack 6 and the bottom of the grip member 5. The film material is preferably polyethylene, polypropylene, polyester, or nylon alone, or two types laminated together.

Next, the skirt member 2 of the stamp unit 1 will be described with reference to FIGS. 5, and 7 through 9. The skirt member 2 is integrally formed of an upper skirt portion 13 and a lower skirt portion 15. The upper skirt portion 13 has an inside wall 11 and an outer wall 12. The lower skirt portion 15 has an outer wall 14 formed continuously to the outer wall 12 but has a large circumference so that it is stepped with respect to the outer wall 12. The skirt member 2 has a rectangular-shaped opening portion 10 where the holder 4 fits from below, and slidably guides the holder 4 relative to the surface of the inner wall 11 within the opening portion.

A spring engage portion 17, which engages an end of a torsion spring 16 so that the holder 4 is urged upward within the opening portion 10, is formed at upper portion of the inner wall 11 at both the left and right end surfaces of the upper skirt portion 13. A half-moon shaped positioning protrusion 18, which receives a coil portion of the torsion spring 16, is formed below and inclined or offset from the spring engaging portion 17. Further, vertical grooves 19, which receive slidably therein inclined protrusions 35 (described hereinafter), are formed at substantially center of the inner wall 11. A spring shift suppression member 9 having an aperture portion (not shown) is provided between the vertical groove 19 and the positioning protrusion 18 (refer to FIG. 9). The aperture portion is inserted the torsion spring 16 to regulate a movement of the torsion spring 16 in the direction apart from the bottom end surface of the spring engage portion 17 and to prevent a release of engagement of the torsion spring 16 and the inclined protrusion 35.

The lower skirt portion 15 is placed on a printing paper (not shown) and supports the stamp unit 1 during stamp printing. Support ribs 20 are disposed at lower corner portion of the outer wall 14 constituting the lower skirt portion 15, and support the lower edge of the outer wall 14 with keeping it away from the surface of the printing paper. A down arrow 21, which shows a stamp printing direction, is formed at the center of the outer wall 14.

Figure 10:
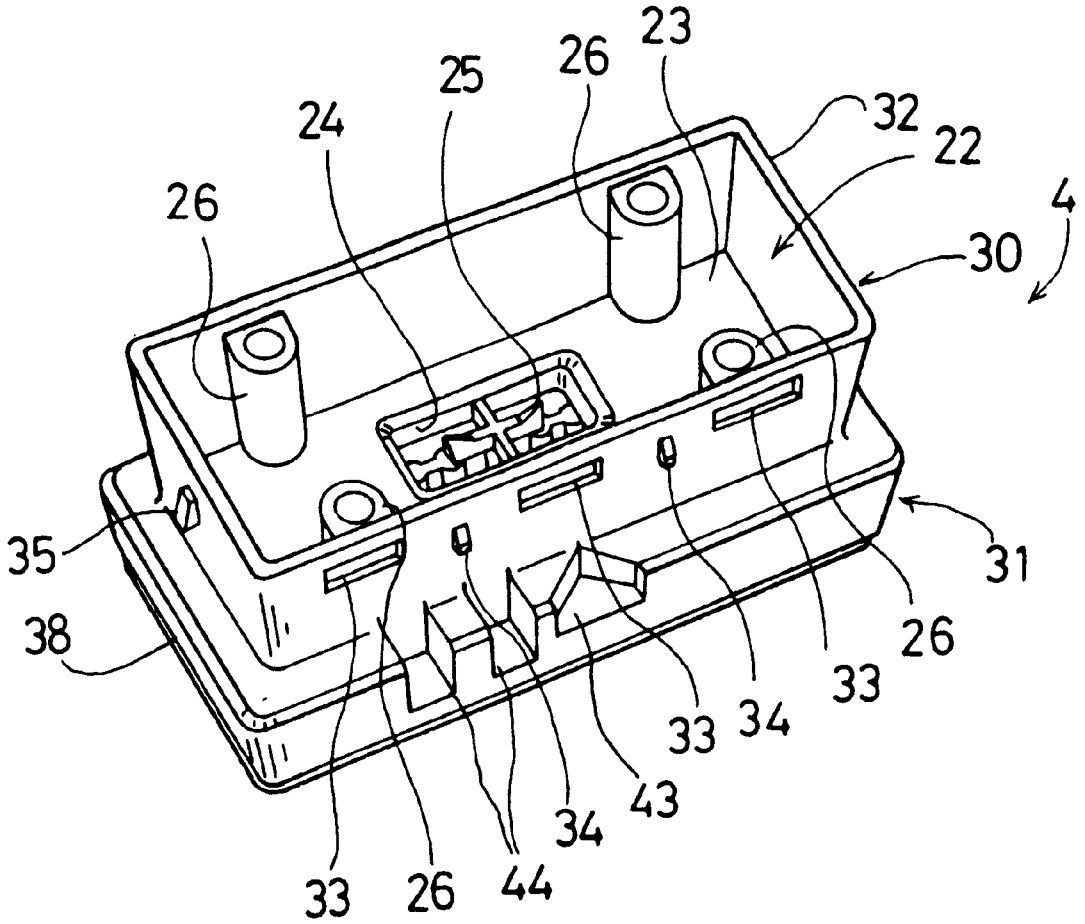
FIG. 10 is a perspective view of a holder.
Figure 11:
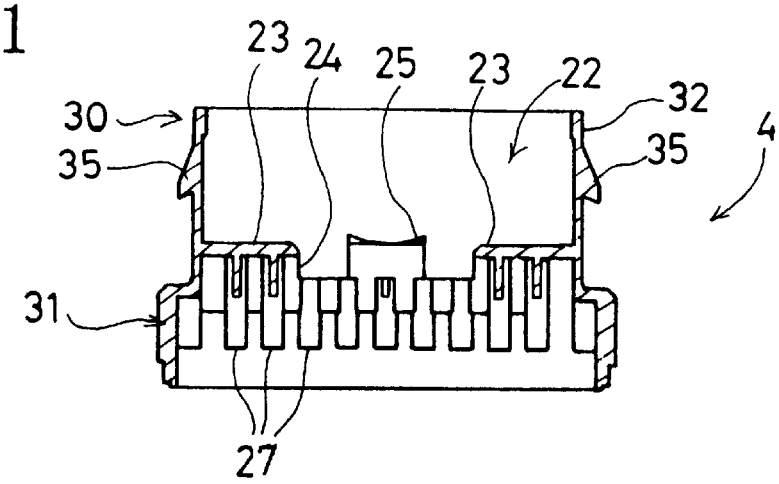
FIG. 11 is a sectional side view of the holder.
Figure 12:
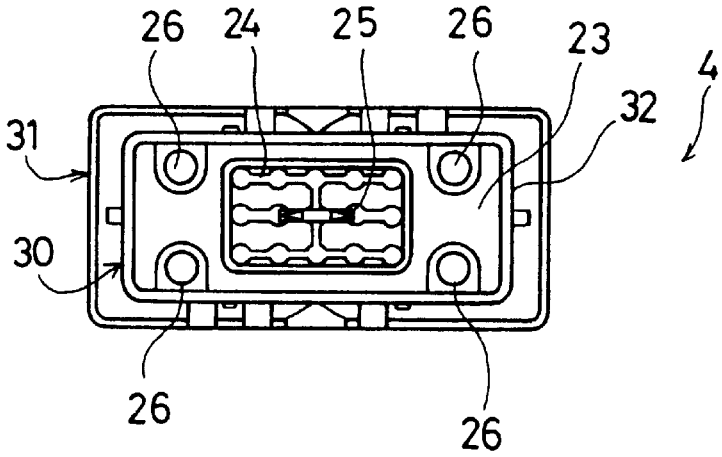
FIG. 12 is a plan view of the holder.
Figure 13:
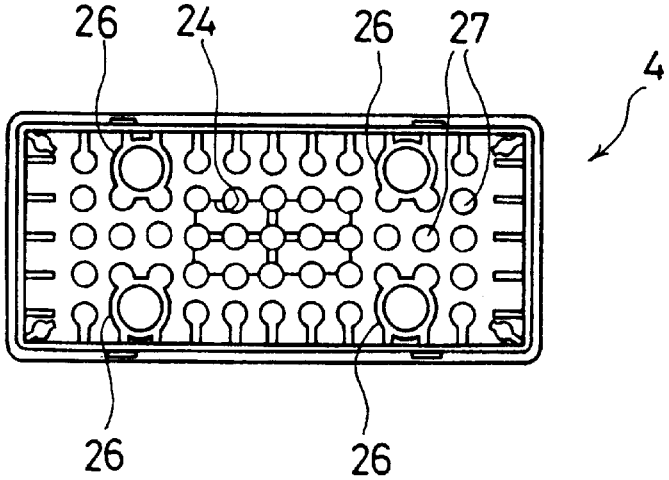
FIG. 13 is a bottom view of the holder.

Next, the holder 4 will be described with reference to FIGS. 5, 6, 7, and 10 through 13. FIG. 10 is a perspective view, FIG. 11 is a sectional side view, FIG. 12 is a plan view, and FIG. 13 is a bottom view of the holder 4. As shown in these figures, the holder 4 is similar to the upper skirt portion 13 and the lower skirt portion 15 in shape and comprises an upper holder portion 30 and a lower holder portion 31 in a unitary body. The upper holder portion 30 has a circumference side wall 32, which has a substantially rectangular pipe shape when viewed from above. Three grooves 33, which have laterally elongated shape, are provided in a horizontal line at an upper portion of the front side wall and the rear side wall of the circumferential side wall 32. Regulating ribs 34, which are wedge-shaped and inclined downward away from the surface of the circumference side wall 32, are provided on both sides of the center groove 33. Rib engaging grooves (not shown) of the grip member 5 are engaged with each grooves 33, so that the holder 4 and the grip member 5 are joined together to form a single body. The regulating ribs 34 act to contact the upper edge of the outer wall 12 of the upper skirt portion 13 of the skirt member 2 and to regulate the amount of downward movement of the holder 4 when the holder 4 is moved downward during stamp printing.

The inclined protrusions 35, which are wedged-shaped and inclined downwardly and outwardly from the surface of the circumference side wall 32, are provided on both end surface (left and right ends in FIG. 11) of the circumference side wall 32 of the upper holder 30. The inclined protrusions 35 are inserted into the vertical grooves 19 of the upper skirt member 13 to be slidable in the axial direction when the holder 4 is inserted from the bottom of the skirt member 2, and the other end of the torsion spring 16 is fixed at the lower end of the respective inclined protrusions 35. The holder 4 is slidably supported in the axial direction within the skirt member 2 by cooperation of inclined protrusions 35 and the vertical grooves 19. One end of the torsion spring 16 is engaged by the lower end of the spring engaging portion 17 of the upper skirt portion 13, the other end of the torsion spring 16 is engaged by the lower end of inclined protrusions 35. Therefore, the holder 4 is always energized upward within the skirt member 2.

The ink pack storing portion 22, which is a substantially rectangular parallelpiped shape and surrounded by the circumference side wall 32 of the upper holder portion 30 of the holder 4, has a flat bottom surface 23 with an ink flow hole 24, connected to the lower holder portion 31, in the center. Further, a cutting rib 25, which protrudes a little beyond the bottom surface 23, is provided for cutting and opening the ink pack 6.

Four oval-shaped ink supply holes 26, which reach from the top end of the holder 4 to the bottom surface of support rods 27 (refer to FIG. 13), are provided on the inner wall surface of the ink pack storing portion 22. The ink supply holes 26 are used to supplement ink without using another ink pack 6 when the amount of ink in the stamp material 3 supplied by the ink pack 6 becomes insufficient. In such a case, ink is poured through the ink supply holes 26 with the grip member 5 detached.

Further, as shown in FIG. 13, a plurality of support rods 27, which are several millimeters in length and are circular cylindrical shaped, are provided so as to form a lattice on the lower holder portion 31 of the holder 4. The support rods 27 extend to the bottom end of the lower holder portion 31 and contact the stamp material 3 held by the holder 4. The bottom ends of the support rods 27 substantially form a plane. The lower holder portion 31 integrally formed with the upper holder portion 30 as a single body and has a circumference side wall 38 which is larger than the circumference side wall 32. The skirt member 2 and the holder 4 are made of polyolefine resin such as ABS resin, polyacetal copolymer, polypropylene, polyethylene, nylon, or PC resin.

The cutting rib 25, which points upward, acts to cut and open the ink pack 6 when the ink pack 6 is pressed downward via the thick paper plate 37 by the grip member 5. The corner portions of the cutting rib 25 are formed to be sharp so that ink pack 6 can be reliably opened.

Inclined grooves 43 are formed having an inwardly directed wedge shape at a substantially outer center position of longitudinal wall of the circumferential side wall 38 of the lower holder portion 31. One or more detecting grooves 44 are formed at the sides of inclined grooves 43. The inclined grooves 43 are used for setting the holder 4 to a predetermined position of the stamp making portion 106 in the stamp making apparatus 100 when making a stamp plate onto the stamp material 3 using the stamp making apparatus 100. As both sides of inclined grooves 43 have an inclined surface, the holder 4 is moved so that a positioning member contacts the center portion of the inclined grooves 43 based on a cam effect between the positioning member in the positioning mechanism and the inclined surfaces. Therefore, the holder 4 is set to a predetermined stamp making position in the stamp making apparatus 100.

As shown in FIGS. 7 and 8, a label portion 50 is formed on the upper surface of the grip member 5, which has a box shape but whose bottom is opened. A label, which indicates the contents of the stamp formed on the stamp material 3 by the previously described method, is pasted on the label portion 50. Further, an insertion portion 51, which is inserted into the circumference side wall 32 of the upper holder portion 30 of the holder 4, is formed on the inside surface of the top of the grip member 5 as shown in FIG. 7. The insertion portion 51 acts to press downward the ink pack 6, disposed in the holder 4, via the thick paper plate 37, and to press downward the holder 4 against the skirt member 2.

Ribs are formed inside of the long sides of the rectangular shaped grip member 5. The ribs are fitted into each groove 33 formed on the upper portion of outer wall of the circumference side wall 32 of the holder 4. Therefore, the holder 4 is integrally connected to the grip member 5.

A plurality of ribs are formed in a vertical direction on the surface of the inner wall of the grip member 5. The ribs formed on the surface of the side wall are formed stepped portions 55 thereon (refer to FIG. 8). The stepped portions 55 contact the upper end of the short wall of the inner wall 11, forming the rectangular-shaped opening portion 10 of the skirt member 2, so that the holder 4 is prevented from sliding more than necessary during stamp printing when the holder 4 is slid downward within the skirt member 2 so as to print by the stamp material 3.

In FIGS. 5 through 8, the stamp material 3, held at the lower end portion of the holder 4, is formed having a three layer structure. An upper layer 71 is made of a hard porous resin approximately 3 mm thick, such as a polyvinyl formal of 90% porosity. A middle layer 72 is made of a hard porous resin, approximately 2 mm thick, such as the same material as the upper layer 71. A lower layer 73 is made of a soft porous resin, such as an urethane resin of 65% porosity, with a light energy absorption material in black, such as carbon black, being dispersed therein. The middle layer 72 and the lower layer 73 are adhered to each other by an adhesive pasted in a lattice shape. The upper layer 71 and the middle layer 72 are not adhered each other artificially.

The lower layer 73 of the stamp material 3 is formed a stamp surface thereof by stamp making and directly contacts a printing paper when stamp printing.

A plurality of slits 74, which passes completely through from top to bottom, are provided on the upper layer 71 at appropriate intervals (refer to FIG. 5). Therefore, ink, which is supplied from the ink flow hole 24 and is dispersed over the upper layer 71, immediately reaches the middle layer 72 through the slits 74, and is dispersed over and impregnates its surface. A plurality of holes, which are circular in cross section and has 1 to 2 mm in diameter, can be provided instead of the slits 74.

The circumferential edge portion of the lower layer 73 of the stamp material 3 and the lower edge of the holder 4 are pressed together and thermally adhered to each other. At the time, the circumferential edge portion of the lower layer 73 is formed having a inclined surface, and the lower edge of the holder 4 is pressed and sealed so that the circumference edge of the lower layer 73 is hitched to the lower edge of the holder 4. As shown in FIG. 6, the pores in the inclined circumferential edge portion of the lower layer 73 of the stamp material 3 are closed with a seal material 75, such as liquid silicone rubber which hardens under ambient temperature by condensation, so that ink does not flow from the circumferential edge portion of the lower layer 73. A stamp plate, as a stamp surface 76, is formed on the surface of the lower layer 73 of the stamp material 3, except at its circumferential edge portion to which the seal material 75 is applied. When cutting the lower layer 73 and the middle layer 72 of the stamp material 3 to a predetermined size using a cutting edge, the pores in the lower layer 73 and the middle layer 72 can be closed by thermally sealing the circumferential edge using the heated cutting edge.

The number and the position of detecting grooves 44 formed on the holder 4 are different according to the size of the holder 4. The detecting grooves 44 are used for specifying the size of the holder 4 by cooperation of a groove sensor 45 (refer to FIG. 14) provided within the positioning mechanism 116 in the stamp making apparatus 100. The inclined grooves 34 and the detecting groove 44 are formed on the both sides of the circumference side wall 38 in the longitudinal direction so that they are rotationally symmetrical. By doing so, a stamp plate can be made on the stamp material 3 even though the front side and the back side of the holder 4 is reversed when the holder 4 is set to the predetermined stamp making position by the positioning mechanism 116 in the stamp making apparatus 100.

Next, a process of forming a stamp plate on a stamp material will be described. First, as a cut sheet type transparent film (draft sheet 8) is transported in a stamp making apparatus 100, and character and image are printed thereon using a thermal head 113 and an ink transfer ribbon to make a positive copy, and then the positive copy is further transported to a predetermined position on the transparent plate 119 so that the positive copy is opposed to the lower layer of the stamp material 3 of the holder 4, which is set to the predetermined stamp making position later.

Next, the holder 4 is set to the predetermined stamp making position in a stamp making apparatus 100. At the time, the holder 4 is set to the predetermined stamp making position in the stamp making apparatus based on cam effect between the positioning member in the positioning mechanism 116 and the inclined surfaces of the inclined grooves 43 formed on the lower holder portion 31. The size of the holder 4 is specified by cooperation of detecting grooves 44 and the groove sensor provided within the positioning mechanism 116.

When a xenon tube emits light under this condition, the lower layer 73 of the stamp material 3 is lighted through the positive copy. Then, only the portion of the lower layer 73, which is lighted through the transparent portion of the positive copy, is melted, and is solidified and sealed by the heat generated by the light absorption material. On the other hand, the portion of the lower layer 73 of the stamp material 3, which is neither melted nor solidified, remains as it is and forms characters and the like. Thereby, the stamp plate having a stamp surface, which contains sealed and unsealed portions at the bottom of the stamp material 3, is made.

The normal size holder 4 is placed and hold on the transparent plate 119 within the stamp making portion 106 by such directly placing the stamp surface on the draft sheet 8, and is lighted the light energy using the xenon lamp 120*a*.

However, as shown in FIG. 14, for example, when making stamp materials of various types of holders 60*a*, 60*b*, 60*c*, which are smaller than normal size holder 4 and have various stamp surfaces such as rectangular, square, or round shape (when viewed from above), an attachment 57, which has a rectangular lock shape and is nearly the same shape as the normal size holder 4, is prepared. The attachment 57 is preferably made of a synthetic resin material having proper hardness. Rectangular mounting holes 59*a*, 59*b*, into which can be inserted lower holder portions 31 of the holders 60*a*, 60*b*, or mounting holes 59*c*, into which auxiliary attachments 62 can be inserted, are formed in the attachment 57 so as to penetrate in an axial direction. A transparent sheet 61 is temporary adhered to the bottom of the attachment 57 in a tensioned state, using an adhesive or pressure-sensitive adhesive so as to being attached to and removed from the attachment 57. The transparent sheet 61 supports the holder 60*a*, 60*b* inserted into the mounting holes 59*a*, 59*b*, 59*c*, or the holder 60*c* inserted into a mounting hole 59*d* of the auxiliary attachment 62, so that they do not fall from the attachment 57 and each stamp surface contact the transparent sheet 61. A heat energy may build up at an ink portion (e.g., black ink) of the draft sheet 8 when lighting the light energy. There is a problem that the draft sheet 8 can not be peeled from the stamp surface when the porous in the stamp surface are solidified after melting so as to be closed, if the draft sheet 8 and the stamp surface of the lower layer 73 directly contacts each other because the transparent sheet 61 is not provided. Therefore, the transparent sheet 61 is provided between the draft sheet 8 and the stamp surface, as a heat insulation. The transparent sheet 61 is preferably made of a synthetic resin film material, such as polyethylene, polypropylene, polyester, or nylon, and is approximately 20 $\mu$m to 2 mm in thickness.

Similar to the normal size holder 4, the inclined grooves 43 for positioning the attachment 57, and the detecting grooves 44 for detecting the type of the attachment 57, are hollowed on one side of a longitudinal direction of the attachment 57.

As described above, as a plurality of mounting holes 59*a*, 59*b*, 59*c* are formed in the attachment 57, the holders 60*a*, 60*b*, 60*c* having various shapes of stamp surfaces which are smaller than that of normal size holder 4, can be made stamp plates thereon at one time. Circular, triangular, or trapezoidal mounting hole may be provided other than square or rectangular one. Further, as shown in FIG. 14, when auxiliary attachments 62 are inserted into a rectangular or a square shaped mounting holes 59*a*, 59*b*, 59*c* in the attachment 57, a plurality of auxiliary attachments 62 each having different sizes and shapes of the mounting hole 59d are preferable to be prepared. By doing so, the holders having various sizes or shapes of stamp surface can be inserted into the attachment 57 if the attachment 57 has few sizes and shapes of mounting holes thereof in number. Further, the cost of manufacturing attachments can be reduced.

Figure 15:
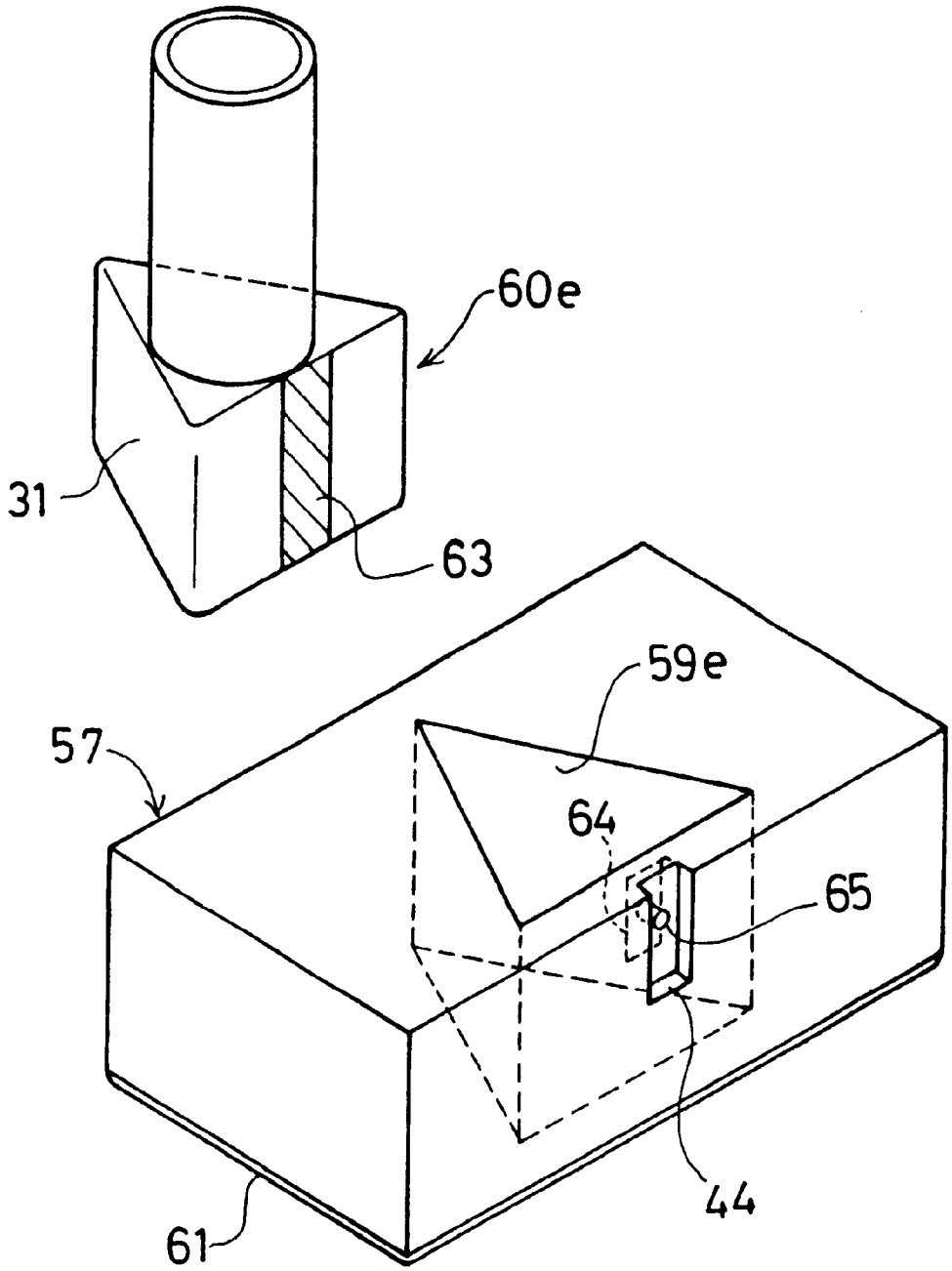
FIG. 15 is a perspective view of an attachment according to a second embodiment.

FIG. 15 shows an attachment 57, formed with one mounting hole 59*e* thereof, according to a second embodiment. In this embodiment, a holder 60*e* having a triangular stamp surface, is inserted into the mounting hole 59*e*. The transparent sheet 61 is provided at the bottom surface of the attachment 57 in a tensioned state so that the holder 60*e* does not fall from its bottom. Further, a first size detecting portion 63, for identifying the type (including size and shape) of the holder 60*e*, is provided on an outer surface of the holder 60*e*. An electric signal input portion 64, which contact against the first size detecting portion 63, is provided at an inner radius of the mounting hole 59*e*. The electric signal input portion 64 is electrically connected to a second size detecting portion 65 in the detecting grooves 44, which is hollowed on the outer surface of the attachment 57.

When the attachment 57 is set in the stamp making portion 106 with the holder 60*e* inserted into the mounting hole 59*e* in the attachment 57, the first detecting portion 63 is detected via the second size detecting portion 65 using a size detector (not shown), which is capable of detecting an electric capacity and provided within the stamp making portion 106 and then the presence of the holder 60*e* can be detected. By extension, the size and type of stamp surface can be easily detected.

Figure 16:
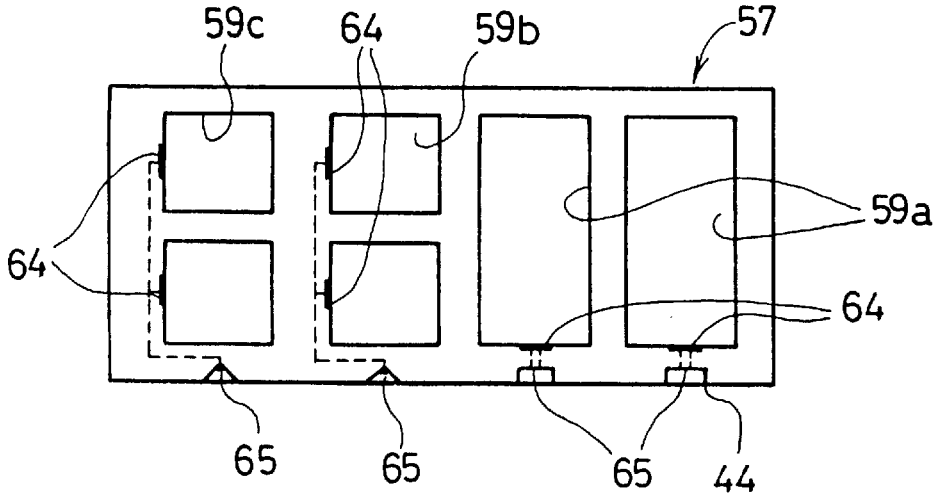
FIG. 16 is a plan view of an attachment according to a third embodiment.

FIG. 16 shows the attachment 57, formed with a plurality of mounting holes 59*a*, 59*b*, 59*c* thereof, according to a third embodiment. Similar to the embodiment shown in FIG. 15, the electric signal input portions 64 are provided at the inner radius of each mounting hole 59*a*, 59*b*, 59*c*, and are electrically connected to the second size detecting portion 65 within each detecting groove 44 on the outer surface of the attachment 57, via lead wire. Therefore, the presence of different sized holders can be detected.

Figure 17:
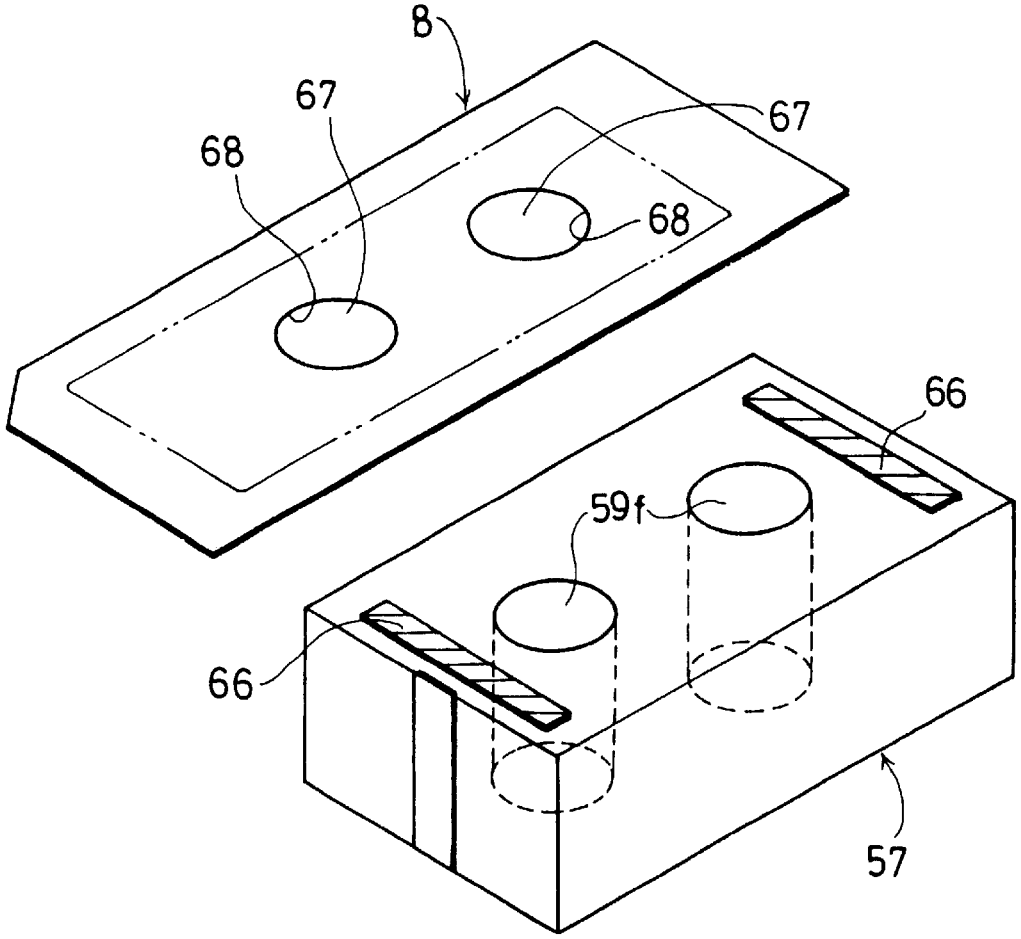
FIG. 17 is a perspective view of an attachment according to a fourth embodiment.

In a fourth embodiment shown FIG. 17, the draft sheet 8 is directly and temporary adhered to the bottom surface of the attachment 57 having mounting holes 59*f* for inserting various (sized) holders (not shown). A plurality of adhesive portions 66, which are made of such as a feeble adhesive (pressure-sensitive adhesive) tape or feeble adhesive rubber, are provided at the bottom surface of the attachment 57. The draft sheet 8 is cut to a predetermined size using a scissors and adhered to the bottom surface of the attachment 57. At the time, as shown in FIG. 17, a ruled line 68, which surrounds a predetermined sized (shaped) stamp area 67 (in which draft data such as characters and images are printed, but not shown in FIG. 17) on the draft sheet 8 and is slightly smaller than the mounting hole 59 in diameter, is provided on the draft sheet 8. The draft sheet 8 can be adhered to and removed from the attachment 57 many times in order to adjusting the position finely so that the stamp area 67 is within the stamp surface area 76 during stamp making.

Figure 18:
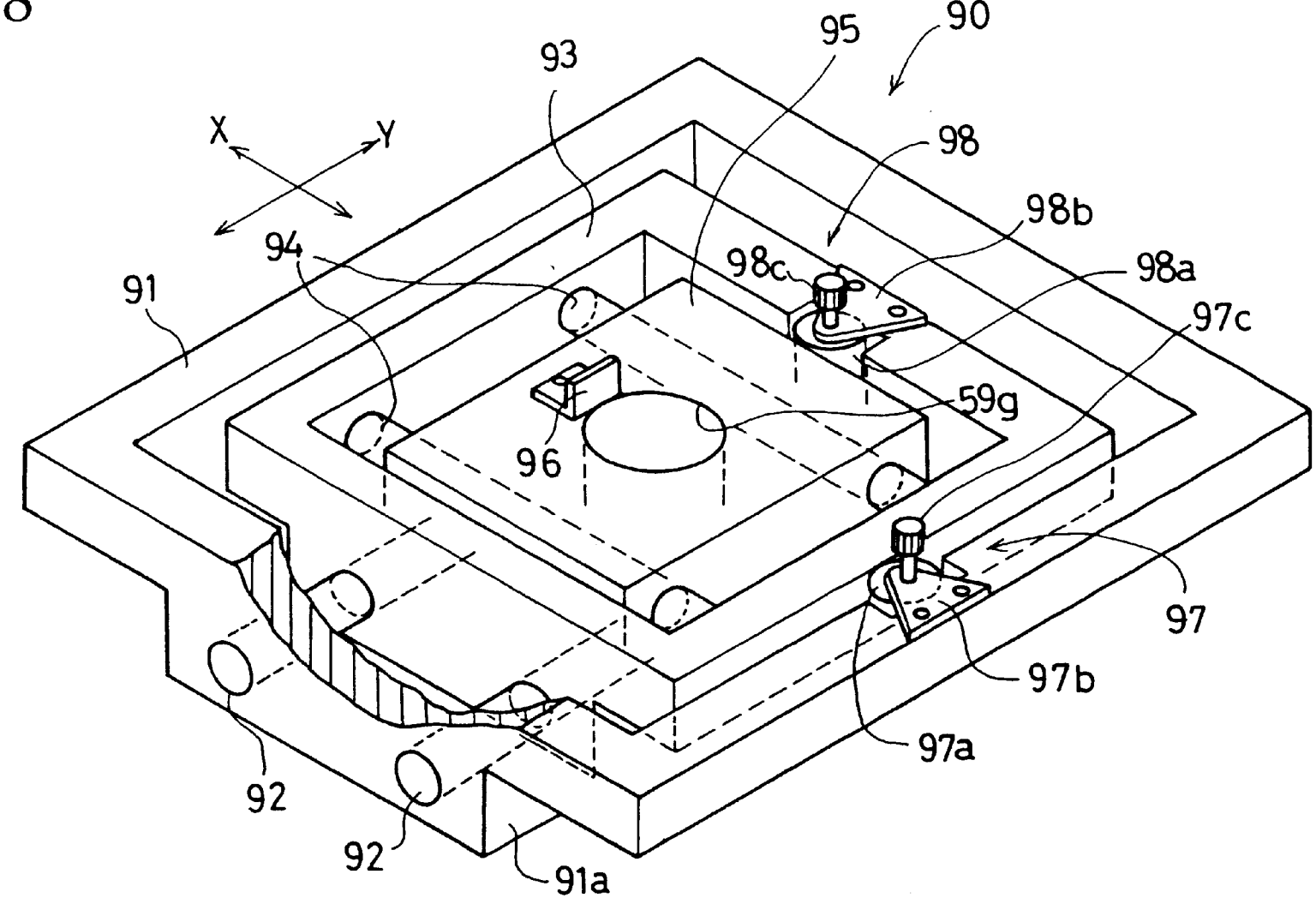
FIG. 18 is a perspective view of an attachment according to fifth embodiment.
Figure 19:
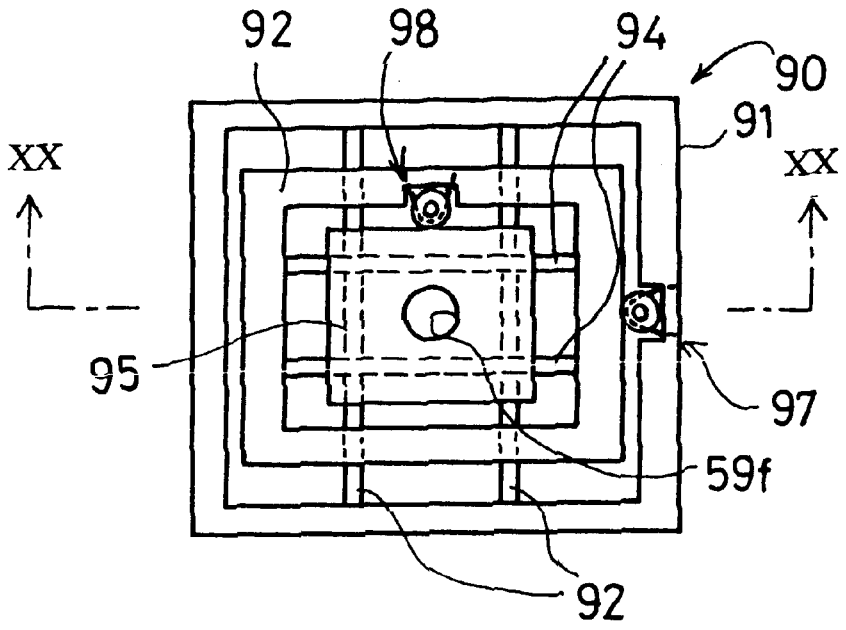
FIG. 19 is a plan view of the attachment according to the fifth embodiment.
Figure 20:
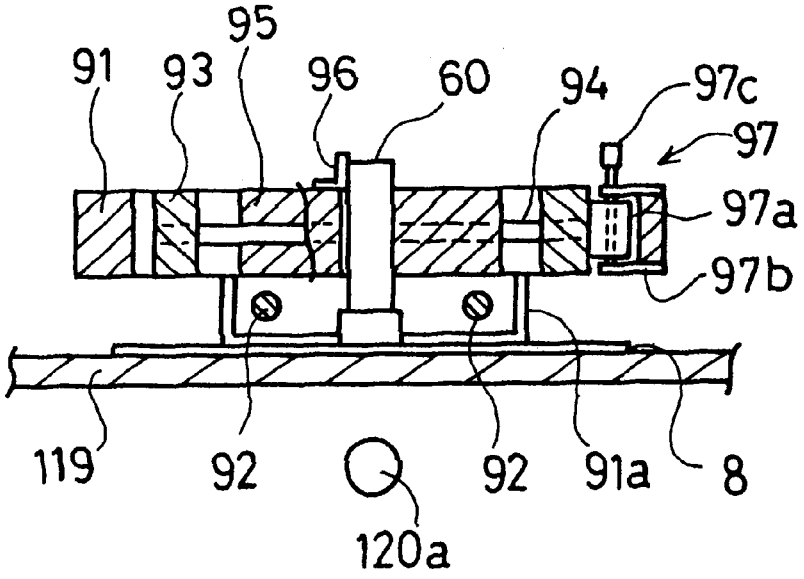
FIG. 20 is a sectional view of the attachment taken on line XX—XX of FIG. 19.

FIGS. 18 through 20 shows a fifth embodiment of a position fine adjustment device 90, which adjusts positions of a stamp area for a draft data area of the draft sheet 8 and a stamp surface area of the holder 4 so that they are aligned each other.

In FIG. 18, a rectangular area surrounded by the circumference of an outer frame 91 is nearly the same in area and shape as a rectangular area surrounded by the circumference of the lower holder portion 31. A pair of feet 91*a* (one foot is shown in FIG. 18), which contact the surface of the draft sheet 8 (or the transparent sheet 61), is integrally provided so as to protrude downward at the front and back ends in the Y direction (e.g., the transparent direction of the draft sheet 8) of the outer frame 91. A pair of Y axis guide bars 92, 92, which extends in the Y direction, is fixed between the feet 91*a*. An inside diameter of a middle frame 93 is slidably disposed to the Y axis guide bars 92, 92, and a pair of X axis guide bars 94, 94, which extends in the X direction, is fixed thereto. An inner block 95 is slidably disposed to the X axis guide bars 94, 94.

A mounting hole 59*g*, into which the upper holder portion 30 of the holder 4 can be inserted, is disposed at substantially center position in the inner block 95 and penetrates in the axial direction. The holder 60 is fixed using a fixing device, such as spring plate, so that the holder 60 does not fall accidentally.

A rubber roller 97*a*, which is a Y direction moving device 97 to move the middle frame 93 reciprocatory along the Y direction, is rotatably disposed in the inside of outer frame 91, via a bracket 97*b*. The circumference of the rubber roller 97*a* is pressed against the outer surface of the long side of the middle frame 93, extending in the Y direction. A knob 97*c* is integrally provided to a rotating shaft with the rubber roller 97*a*. The middle frame 93 is finely adjusted in the Y direction by turning the knob 97*c*.

Similarly, a rubber roller 98*a*, which is a X direction moving device 98, is rotatably disposed in the inside of middle frame 93, via a bracket 98*b*. The circumference of the rubber roller 98*a* is pressed against the outer surface of the long side of the inner block 95, extending in the X direction. A knob 98*c* is provided to a rotating shaft with the rubber roller 98*a*. The inner block 95 can move reciprocatory and is finely adjusted in the X direction by turning the knob 98*c*.

According to such structure, for example, the draft data area (stamp area) can be easily positioned within the stamp surface area of the holder 60 inserted into the mounting hole 59*d* in the inner block 95, even if the position of the draft data area (stamp area) is shifted or the draft sheet 8 is displaced from the stop position after being transported to the stamp making portion 106, due to dislocation of printing to the draft sheet 8. Thus, the stamp area can be adjusted to align with the stamp surface of the holder 60, so that an error of stamp making can be reliably prevented.

Figure 21:
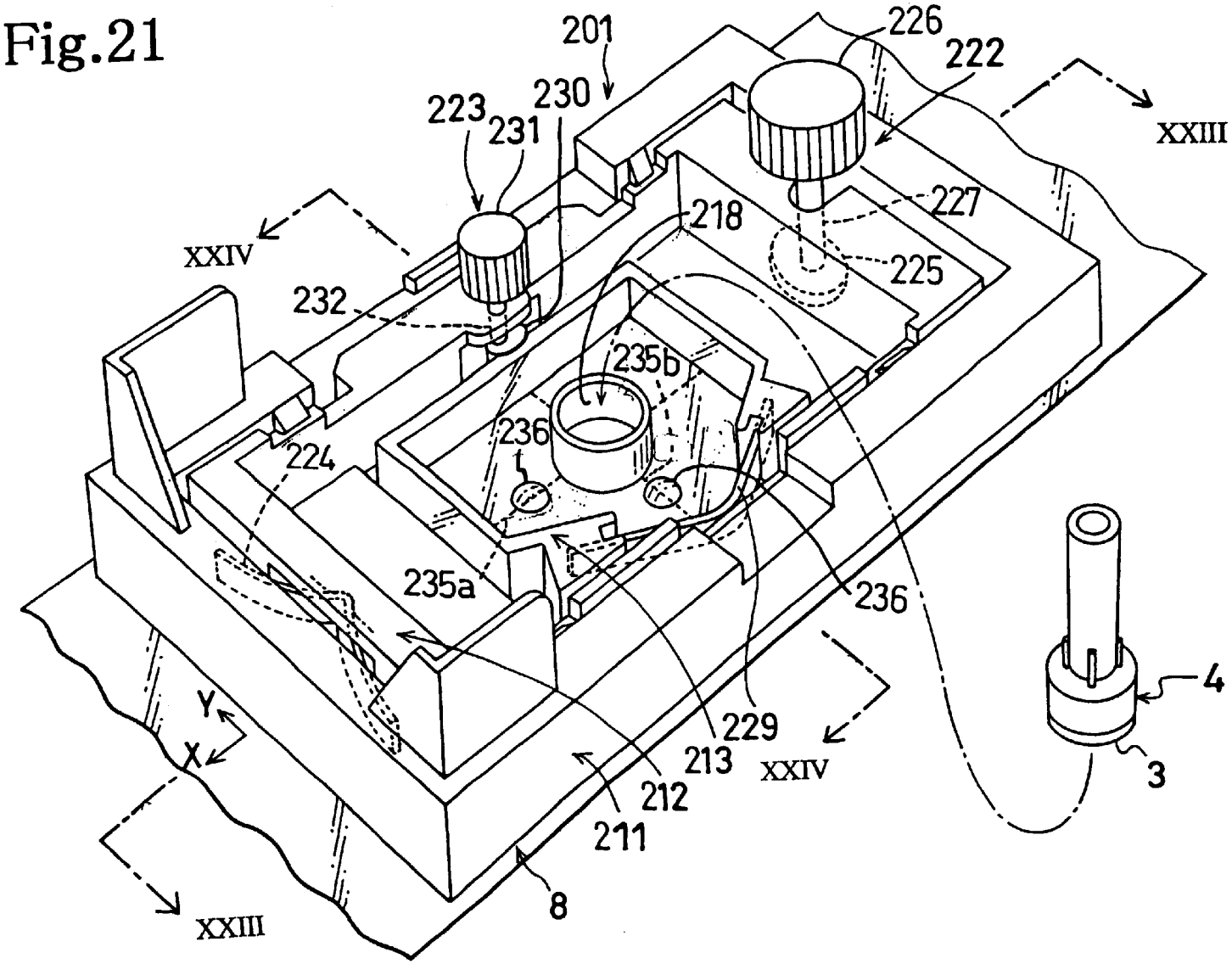
FIG. 21 is a perspective view of an attachment according to a sixth embodiment when viewed from above.
Figure 22:
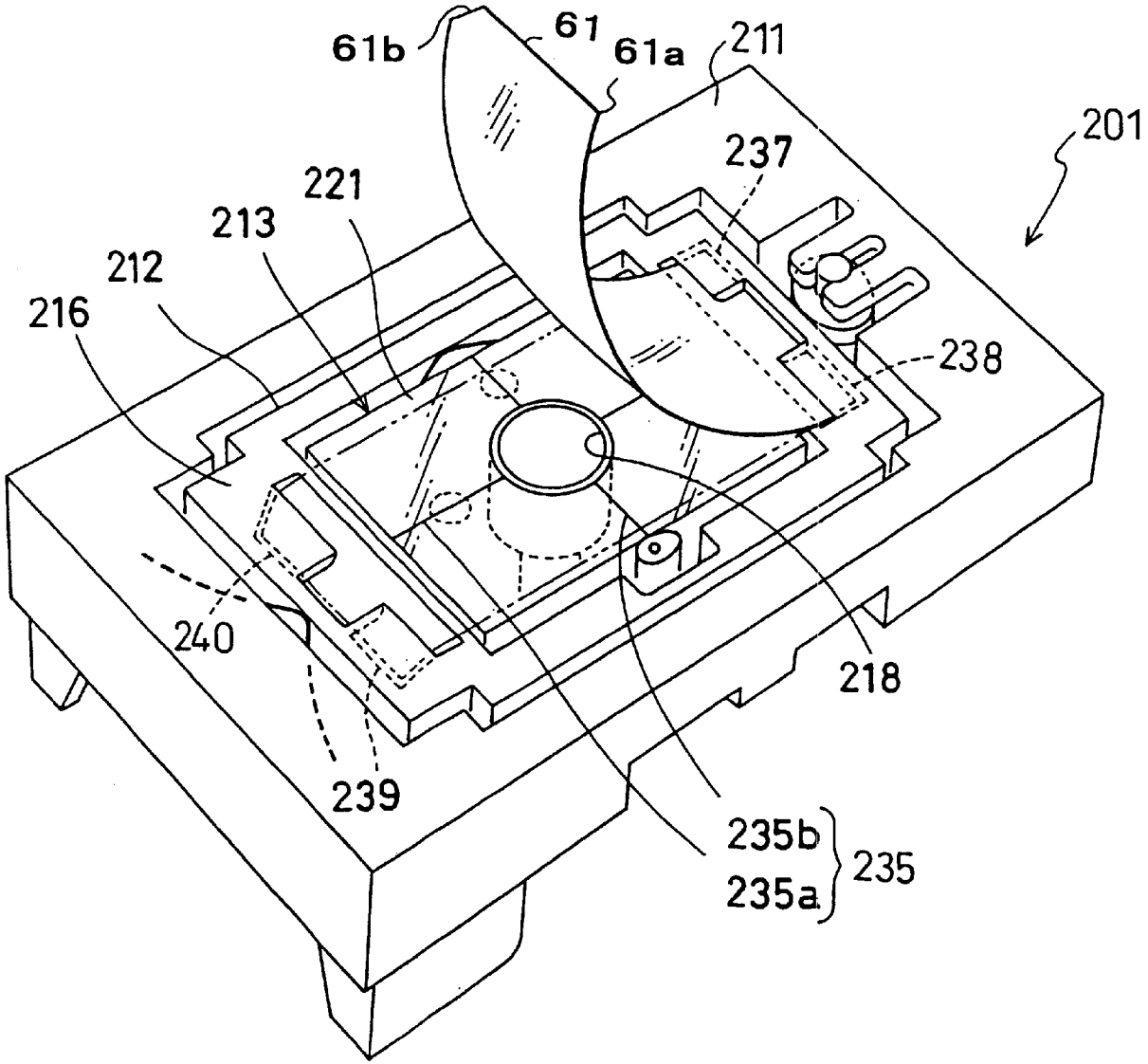
FIG. 22 is a perspective view of the attachment according to the sixth embodiment when viewed from below.
Figure 23:
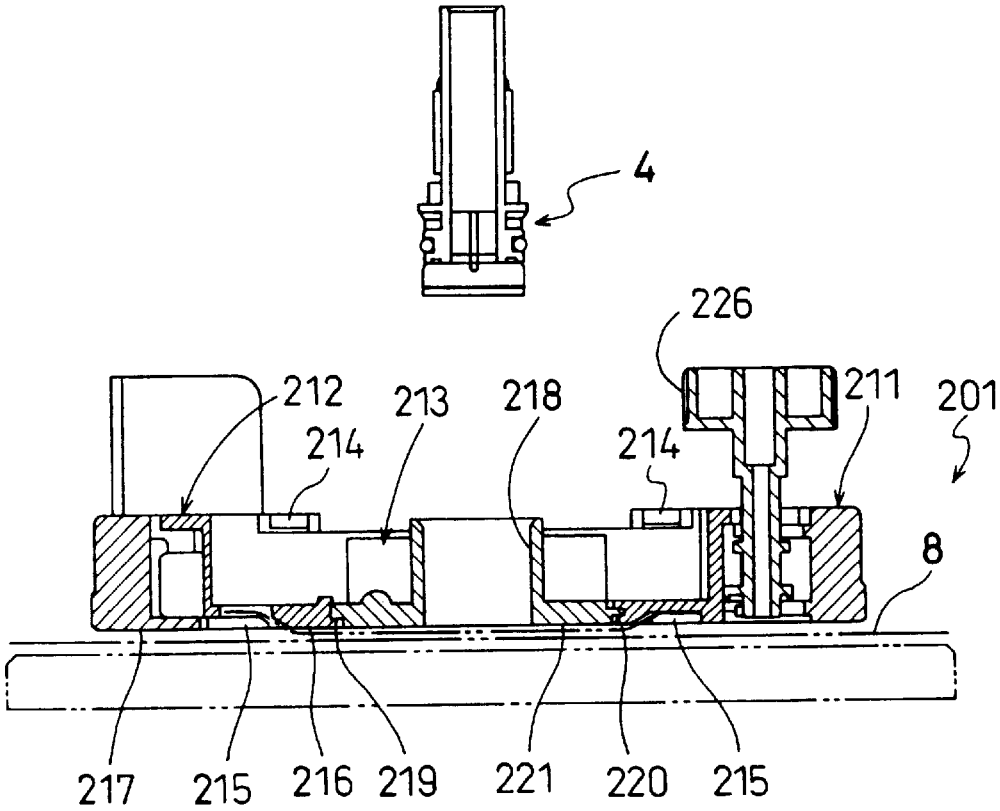
FIG. 23 is a sectional view of the attachment taken on line XXIII—XXIII of FIG. 21.
Figure 24:
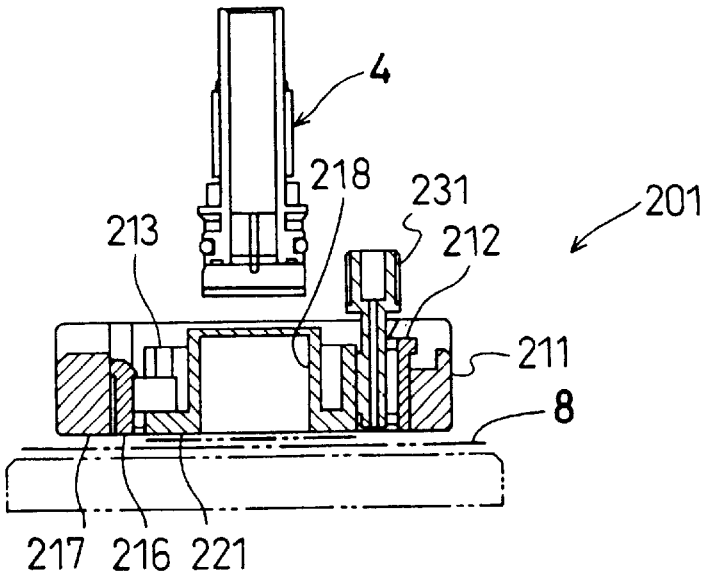
FIG. 24 is a sectional view of the attachment taken on line XXIV—XXIV of FIG. 21.

Next, an attachment according to a sixth embodiment, which is capable of adjusting finely the position of the stamp area of the draft sheet 8 and the stamp surface area of the holder 4 as the fifth embodiment, will be described with reference to the drawings. FIG. 21 is a perspective view of an attachment of a sixth embodiment when viewed from above; FIG. 22 is a perspective view of the attachment according to the sixth embodiment when viewed from bottom; FIG. 23 is a sectional view of the attachment taken line on II—II of FIG. 21; and FIG. 24 is a sectional view of the attachment taken line on III—III.

In FIG. 21, 201 is an attachment, 4 is a holder, and 8 is a draft sheet. In FIG. 21, the attachment 201 is mounted to a predetermined position facing the draft sheet 8 and the micro holder 4, which has a round-shape and a 10 mm in diameter, is to be inserted into a mounting hole 218.

The attachment 201 comprises an outer frame 211, a first slide member 212, and a second slide member 212. A rectangular area surrounded by the circumference of the outer 211 is nearly the same in area and shape as a rectangular area surrounded by the circumference of the normal size holder. The outer frame 211 can be attached to and removed from the predetermined position.

The first slide member 212 has a substantially rectangular frame shape and is slidably fit into the outer frame 211 in the longitudinal direction of the outer frame 211, i.e., in the longitudinal direction of the draft sheet 8. As shown in FIG. 23, the first slide member 212 is slidable in the longitudinal direction of the outer frame 211 by a guide portion 214 of upper side of the outer frame 211 and a guide portion 215 of lower side of the outer frame 211. A bottom surface 216 of the first slide member 212 and a bottom surface 217 of the outer frame 211 are in the same plane.

The second slide member 213 has a box shape and is slidably fit in the lateral direction of the slide member 212, i.e., in the lateral direction of the draft sheet 8. The second slide member 213 has a mounting hole 218 for inserting thereinto and removing therefrom the micro holder 4, at a center of the box-shaped second slide member 213. The mounting hole 218 has a cylindrical-shaped wall which extends from the hole provided on the bottom of the box-shaped second slide member 213. The second slide member 213 is integrally made of a transparent plastic resin. Because the periphery of the mounting hole 218 is transparent, the draft sheet 8 around the holder 4 can be seen when the holder 4 is inserted in the mounting hole 18.

As shown in FIGS. 23 and 24, the second slide member 213 can slide in the lateral direction of the outer frame 211 and the first slide member 212 since concave 219, 220 are internally provided in the first slide member 212. A bottom surface 221 of the second slide member 213 is in the same plane as the bottom surface 216 of the first slide member 212 and the bottom surface 217 of the outer frame 211.

As shown in FIG. 21, a first adjusting device 222, which moves the mounting hole 218 in the longitudinal direction of the draft sheet 8 (in the Y direction in FIG. 21), is provided between the outer frame 211 and the first slide member 212. A second adjusting member 223, which moves the mounting hole 218 in the lateral direction (in the X direction in FIG. 21), is provided between the first slide member 212 and the second slide member 213. The longitudinal direction and the lateral direction intersect at right angles, as shown in FIG. 21.

The first adjusting device 222 comprises a spring 224, an eccentric cam 225, and a knob 226 for rotating the eccentric cam 225. The spring 224 is a V-shaped plate spring which is existed between the outer frame 211 and the first slide member 212 and urges the first slide member 212 in one of the sliding direction. A shaft 227 is rotatably supported by the outer frame 211 and is disposed adjacent to the side wall opposed to the side wall to which the spring 224 contacts. The shaft 27 is provided with the eccentric cam 225. A cam surface contacts the outer wall of the first slide member 212. The knob 226 is integrally provided at the portion protruding upward of the shaft 27. When the knob 226 is turned using fingers, the first slide member 212 is slightly reciprocated in the longitudinal direction of the draft sheet 8 according to the eccentricity of the eccentric cam 225. As shown in FIG. 23, the knob 26 is disposed so as to be inside of the outside shape of the outer frame 211, so that the knob 226 is out of the way of installation of the attachment 201 and can be easily turned after installation.

The second adjusting device 223 comprises a spring 229, an eccentric cam 230, and a knob 231 for rotating the eccentric cam 230, and is disposed in the direction orthogonal to the first adjusting member 222. The spring 229 is a V-shaped plate spring which is existed between the first slide member 212 and the second slide member 213 and presses against the second slide member 213 in one of the sliding direction. The knob 231 is integrally provided at the portion protruding upward of the shaft 232. When the knob 231 is turned using fingers, the first slide member 212 is slightly reciprocated in the lateral direction of the draft sheet 8 according to the eccentricity of the eccentric cam 230. As shown in FIG. 24, the knob 231 is disposed so as to be inside of the outside shape of the outer frame 211, so that the knob 231 is out of the way of installation of the attachment 201 and can be easily turned with the holder 4 attached.

As shown in FIG. 22, reference lines 235*a,* 235*b* are provided in the shape of a cross on a back of the transparent second slide member 213, for positioning. The reference line 235*a* extends in the longitudinal direction of the outer frame 211 (draft sheet 8). The reference line 235*b* extends in the lateral direction of the outer frame 211 (draft sheet 8). The reference lines 235*a,* 235*b* can be seen through the transparent second slide member 213 from its bottom. As shown in FIG. 21, convex lenses 236, 236 are formed on the reference lines 235*a,* 235*b* of the second sliding member 213, so that the portion where the reference lines 235*a,* 234*b* corresponding to a reference line 8*e,* 8*f* (refer to FIG. 9) formed on the draft sheet 8 can be seen under magnification.

As shown in FIG. 22, a transparent sheet 61 can be provided onto the bottom surface 221 of the second slide member 213 including the mounting hole 218. Insertion portions 237, 238, 239, 240 are formed on four corners of the bottom surface 216 of the first slide member 212. The insertion portions 237, 238, 239 are formed so that the right angled corners 61*a* of the transparent sheet 61 are fit therein. The insertion portion 240 is formed so that a cut portion 61*b* of the transparent sheet 61 is fitted therein. As described above, as the shapes of the insertion portions 237 to 240 are asymmetrically formed in the longitudinal or lateral direction of the second slide member 213 and the four corners of the transparent sheet 61 are also asymmetrically formed in the longitudinal or lateral direction of the second slide portion, the right and wrong sides of the transparent sheet 61 are uniquely determined when inserting. The transparent sheet 61 prevents the holder 4, which is inserted into the mounting hole 218, from falling therefrom. Silicone is applied to the surface of the transparent sheet 61 to be contacted the stamp material 3, to prevent the draft sheet 8 and the stamp material from adhering each other (described hereinafter).

Figure 25:
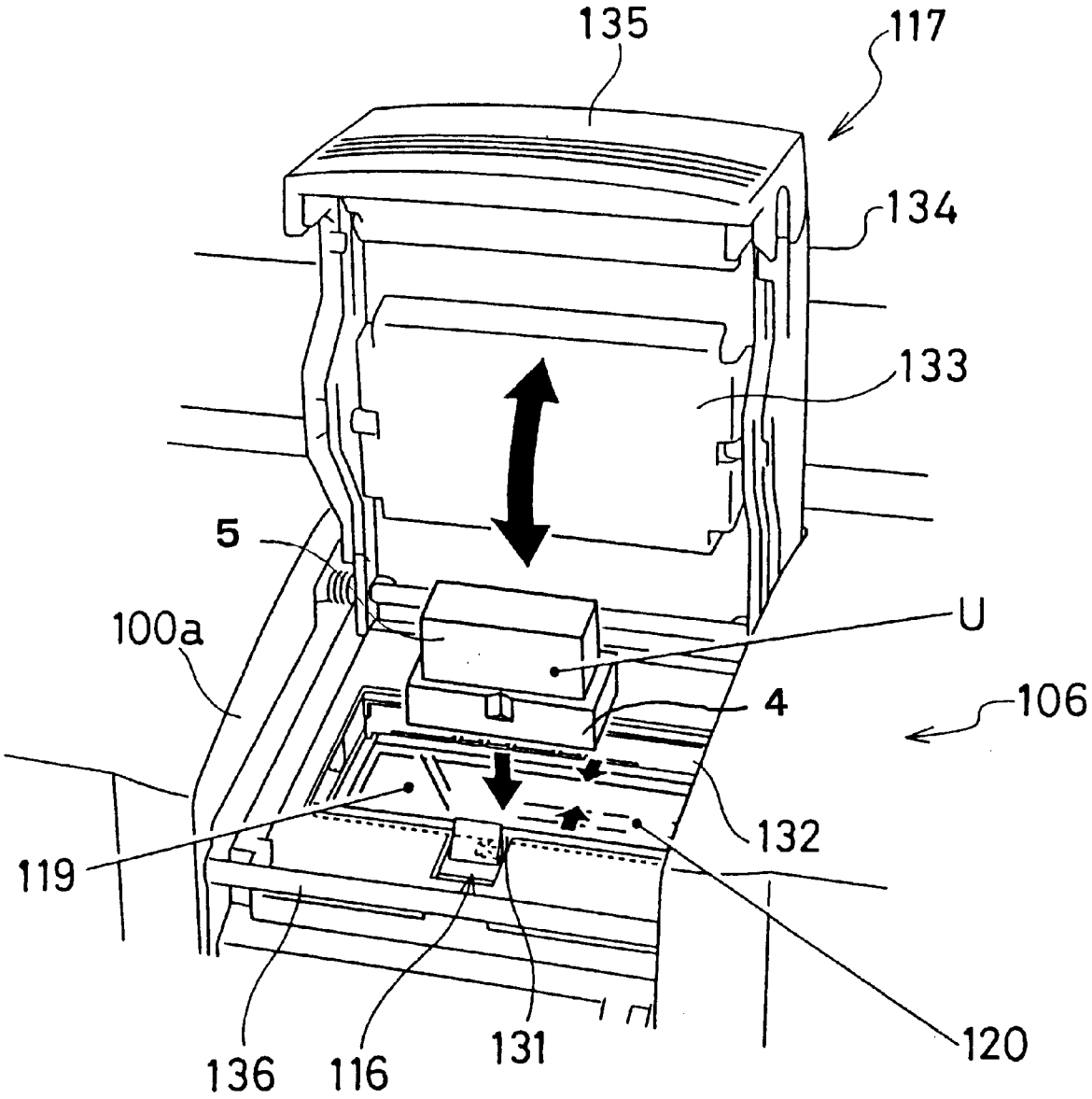
FIG. 25 is a perspective view of the stamp making portion of the stamp making apparatus.

As shown in FIG. 25, the stamp making portion 106 comprises the positioning mechanism 116 for positioning a holder 4 of a stamp unit U, a pressing mechanism 117, the irradiation unit 120, and the transparent plate 119.

The transparent plate 119 is made of such as acrylic resin plate and is set the draft sheet 8, on which an image is formed, thereon. The irradiation unit 120 can be attached to and removed from the accommodating portion under the transparent plate 199*a,* from a right side of the body case 100*a* in a lateral direction. As shown in FIG. 25, the positioning unit 116 has a pair of binding members 131, 132 provided in a lateral direction of the rectangular holder 4. The binding members 131, 132 are pressed so that they synchronously slide toward a center line of the transparent plate 119. Further, a triangular protrusion (not shown) is provided on one of binding members 131, 132, to positioning the rectangular holder 4 in a longitudinal direction. The rectangular holder 4 is attached to a predetermined position in the stamp making portion 106 by the positioning mechanism 106 having the aforementioned structure.

The pressing device 117 comprises a pressing plate 133, an upper cover 134, an upper front cover 135, and a bar 136. The upper cover 134, to which the pressing plate 133 is attached, is attached to the one side of the body case 100*a* so that it can be opened and closed. The upper front cover 135 is pivotably attached to the upper cover 134. The upper front cover 135 is hitched on the bar 136, on which is provided the other side of the body case 100*a,* so that it covers the top of the stamp making portion 106. When closing the upper cover 134 and pushing the upper front cover 135, a predetermined pressure is applied to the rectangular holder 4 by the pressing device 117 having the aforementioned structure, via the pressing plate 133.

The rectangular holder 4 is placed at the predetermined position facing the draft sheet 8 positioned over the upper surface of the transparent plate 199, by the positioning mechanism 116. The stamp material 3 of the rectangular holder 4 is pressed toward the draft sheet 8 by the pressing device 117. When the irradiation unit 120 is operated, the stamp is made on the stamp material 3. The draft sheet 8, on which an image is printed, is discharged from the outlet 122 to outside via the pair of discharge rollers 121. The rectangular holder 4, which a stamp is made on the stamp material 3, can be removed from the stamp making portion 106 by opening the pressing device 117.

Figure 26:
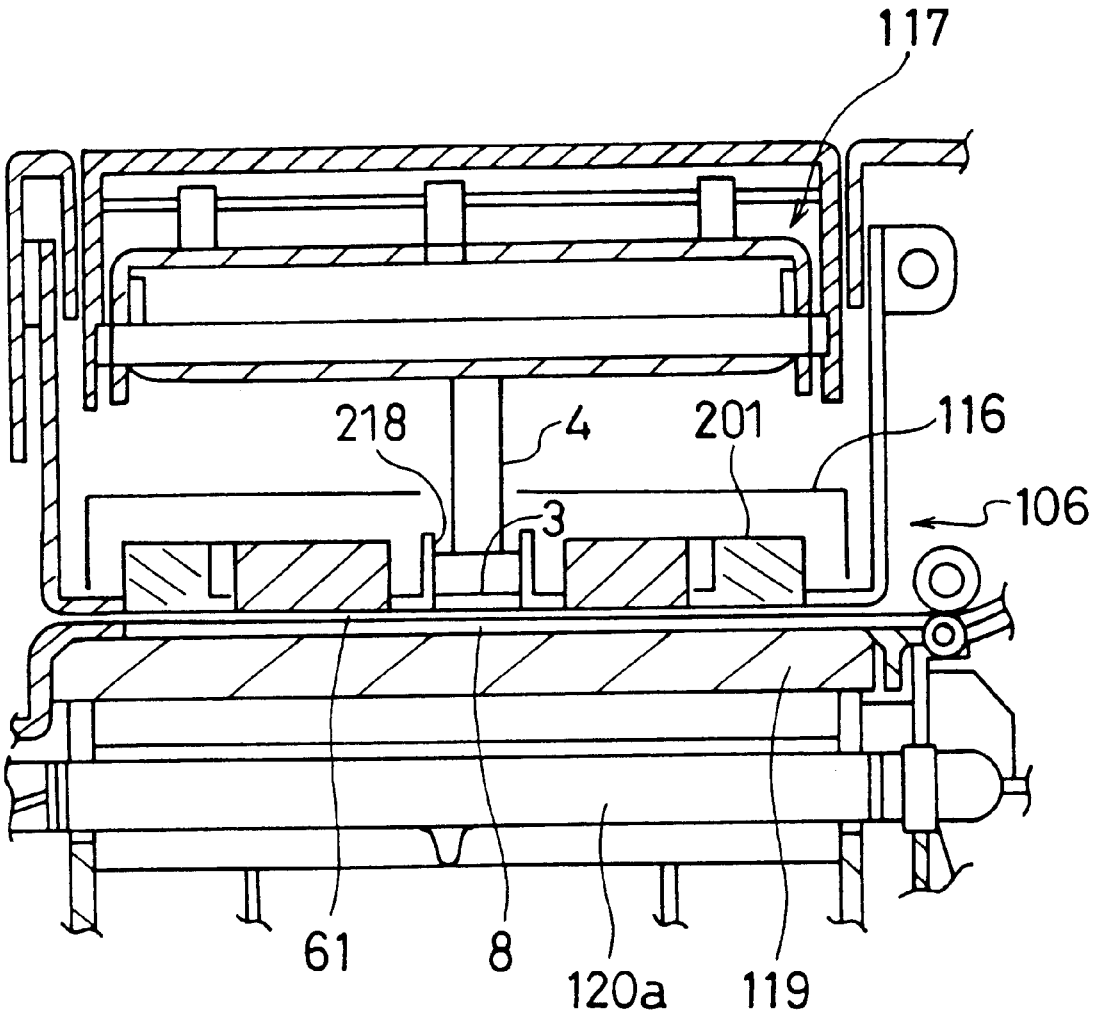
FIG. 26 is a sectional view of the stamp making portion when the holder is set via the attachment.
Figure 27:
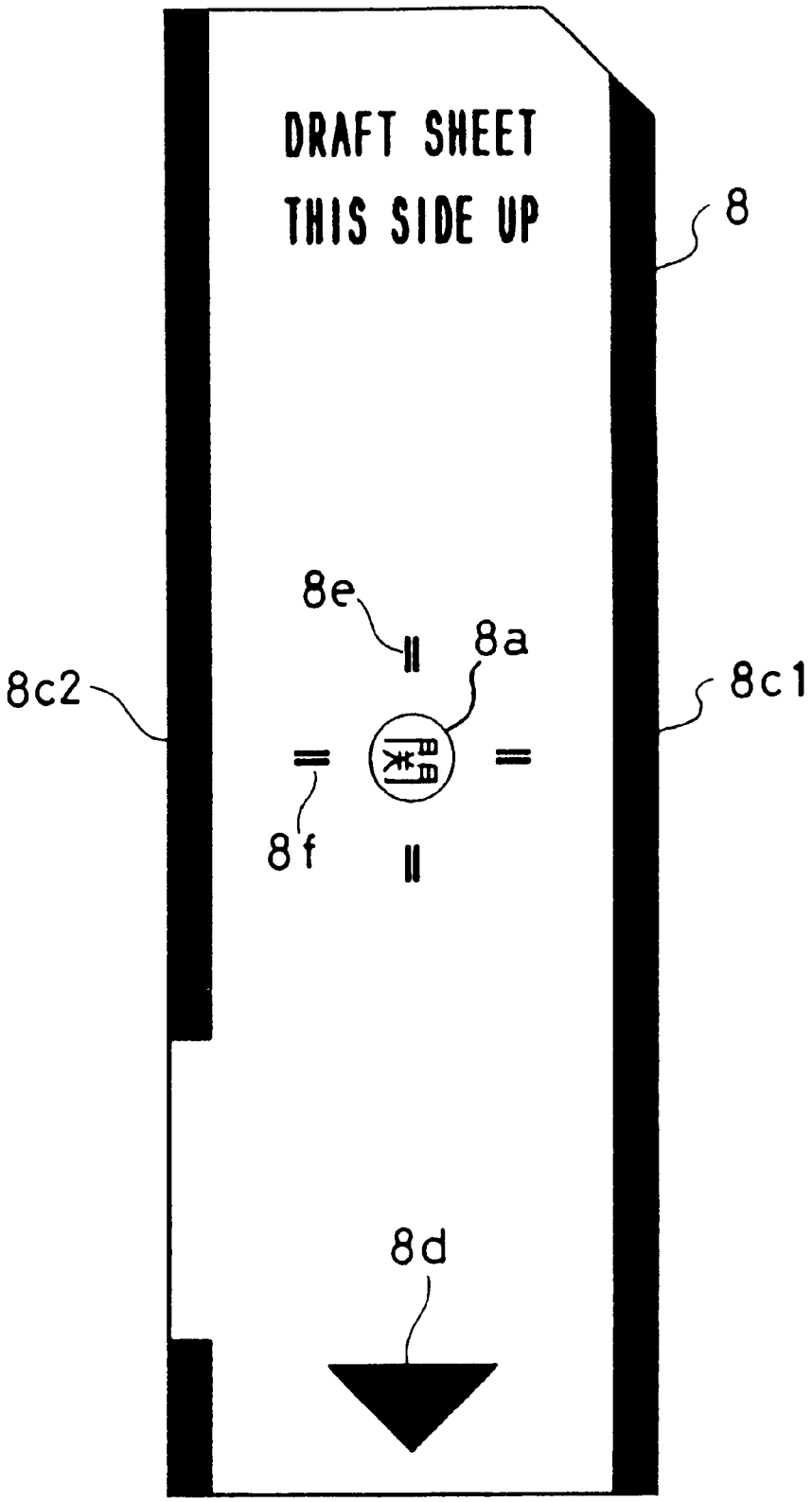
FIG. 27 is a plan view of the draft sheet.

As shown in FIG. 26, in the stamp making portion 106, the attachment 201 can be attached to instead of the rectangular holder 4. For example, the attachment 201 has a mounting hole where the holder 4 holding the micro-sized stamp material 3 can be inserted into and removed from. An outside shape of the attachment 201 is the same as that of the typical rectangular holder, and can be attached to and removed from the predetermined position facing the draft sheet 8 in the stamp making apparatus 100.

A micro-sized image 8*a* is formed in the center of the draft sheet 8 of FIG. 7. Around the image 8*a,* the reference line 8*e,* which extends in a longitudinal direction of the draft sheet 8, and the reference line 8*f,* which extends in a lateral direction of the draft sheet 8, are printed at the time the image 8 is printed. The reference lines 8*e,* 8*f* are two thick lines. When the reference lines 235 of the attachment 201 are positioned between the two thick lines, the draft sheet 8 and the mounting hole 218 of the attachment 210 can be positioned.

Figure 28:
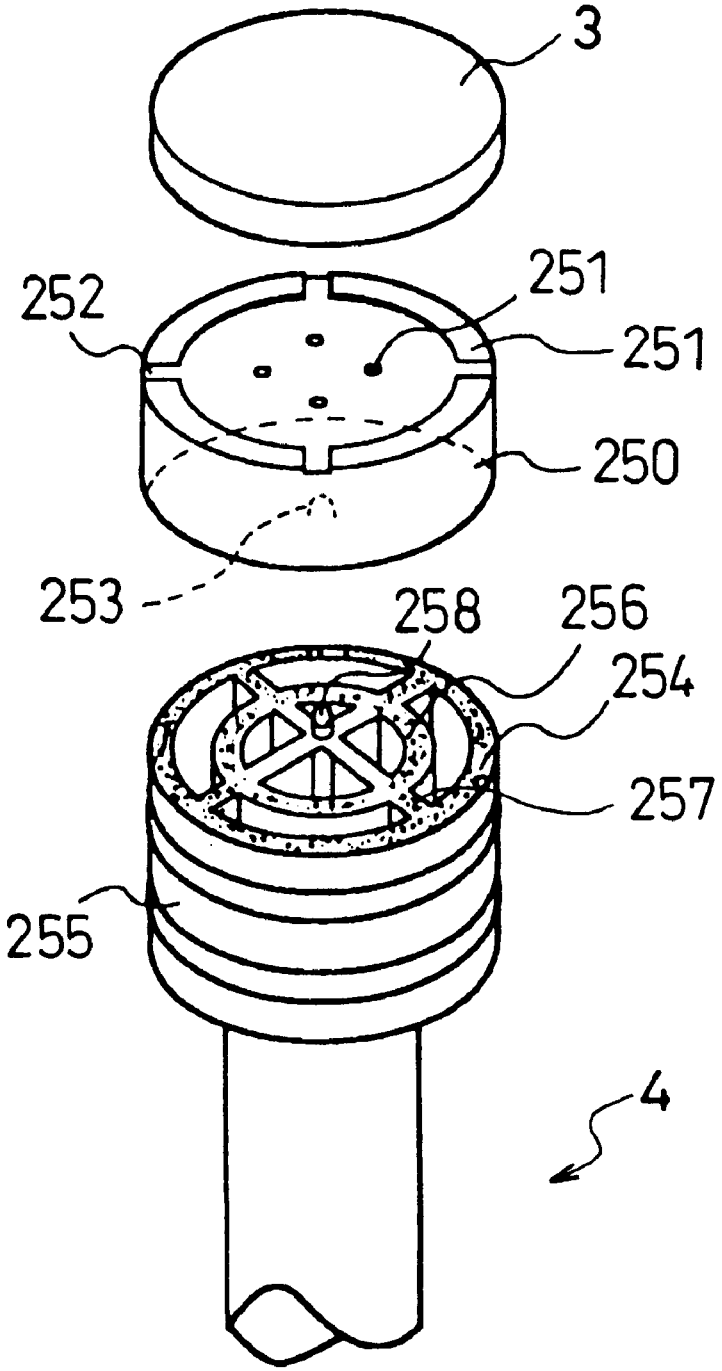
FIG. 28 is an exploded perspective view of the holder holding a stamp material.

FIG. 28 is a exploded view of the micro holder 4 holding the stamp material 3. The holder 4 holds the stamp material 3 via an ink absorber 250. The bottom of the holder 4 has a hollow cylinderlike wall 256 and plate shaped support pillars 257 disposed in the shape of a cross within a circumference wall 255. There are hollows between the cylinderlike wall 256 and the support pillars 257. Further, a protrusion 258 is provided at a center of the bottom portion of the holder 4 so as to fit into a concave 253 of the ink absorber 250. The holder 4 and the ink absorber 250 are positioned by joining the protrusion 258 and the concave 253 and are adhered each other using a double-sided adhesive tape which has the same width as the width from the periphery of the circumference wall 255 to the inner radius of the cylinderlike wall 256.

The stamp material 3 has a cylindrical-shape and a flat bottom, and is short in height. The stamp material 3 is preferably made of a soft porous resin approximately 1.2 mm thick, such as an urethane resin, e.g., a polyurethane of 65% porosity, with a light energy absorption material, such as carbon black, being dispersed therein. The ink absorber 250 is preferably made of a hard porous resin approximately 3 mm thick, such as polyvinyl formal of 90% porosity. The adhesive 251 is applied to the four portions of the circumference of the ink absorber 250. Adhesive unapplied portions 252 at the circumference are provided for letting air out.

For polyurethane foam resin, for example, the weight ratio of a carbon black contained in the stamp material 3 is generally 0.1 to 15 wt %, preferably 1.0 to 15 wt %, with respect to the resin. Copper chloride, silver bromide, or the like can be used for the light energy absorption material, instead of the carbon black. Further, the stamp material 3 can be made of polyolefine resin, polyvinyl chloride resin, or rubber resin other than urethane resin.

Figure 29:
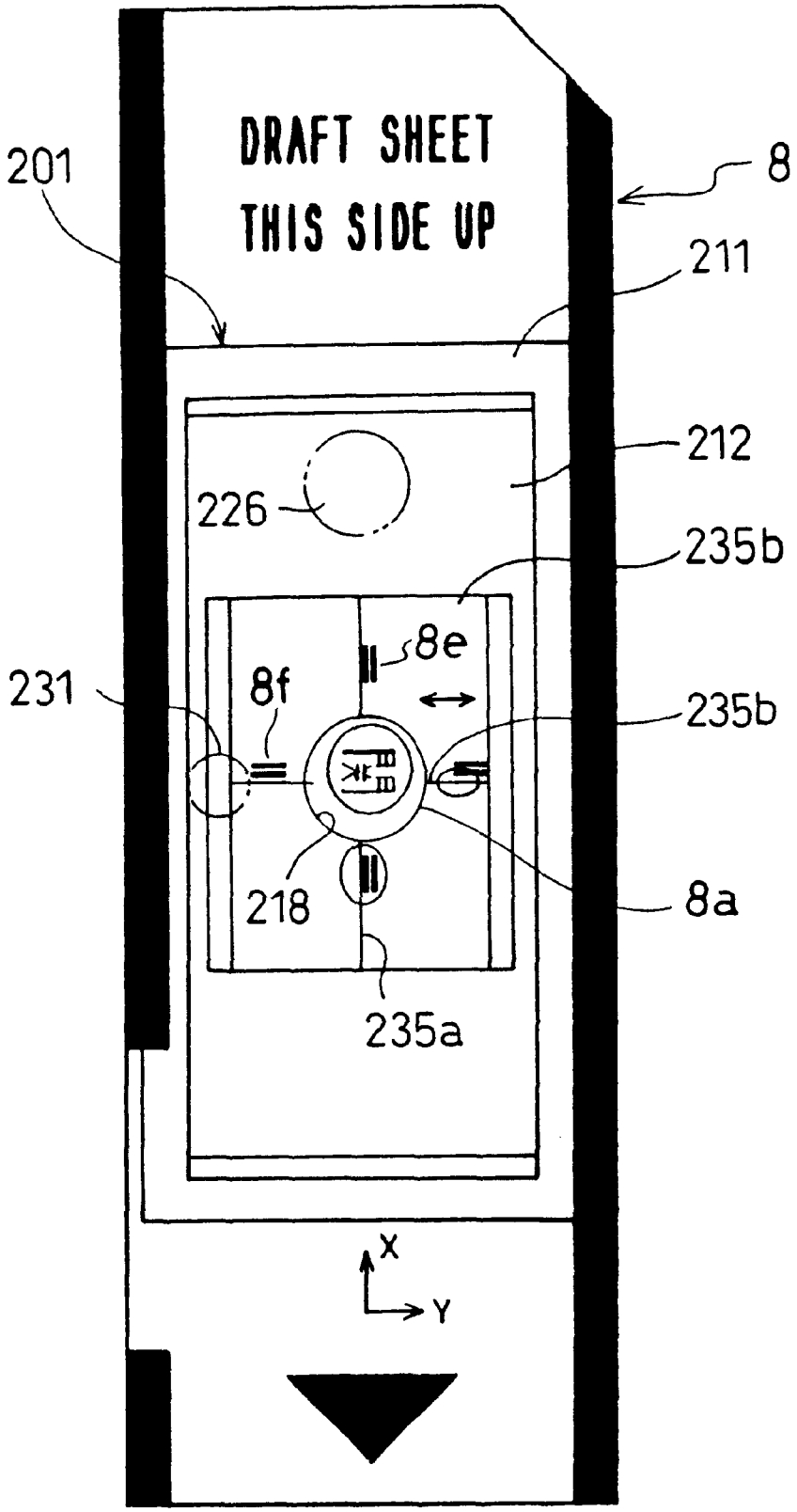
FIG. 29 is an explanatory diagram showing a position adjustment of the stamp material against the draft sheet.

Next, a procedure for making a micro stamp plate, by installing the attachment 201 into the stamp making apparatus 100 and inserting the holder 4 holding the stamp material 3 into the attachment 201, will be described with reference to FIGS. 21, 22, 29, and so on.

In FIG. 22, the transparent sheet 61 is fitted to the bottom of the first slide member 212 of the attachment 201. At the time, the insertion portions 237 to 240 of the first slide member 212 are asymmetrically formed in the longitudinal or lateral direction. The corners of the transparent sheet 61 are also asymmetrically formed in the longitudinal or lateral direction. Therefore, the transparent sheet 61 is inserted into the insertion portions 237 to 240 so that the surface, to which silicone is applied, always faces the stamp material 3.

In parallel with the preparation of the attachment 201, the draft sheet 8 is made and is transported to a predetermined position over the transparent sheet 61 in the stamp making portion 106 by operating the stamp making apparatus 100 shown in FIG. 2. As shown in FIG. 25, covers 134, 135 of the stamp making portion 106 are opened, and then the attachment 201 is installed instead of the stamp unit U shown in the figure. At the time, the holder 4 holding the stamp material 3 is inserted into the mounting hole 218 in the attachment 201.

There is a case where an image 8*a* printed on the draft sheet 8, is shifted from a proper position due to displacement of draft sheet 8. FIG. 29 shows such situation. Because the second slide member 213 is made of a transparent material, the reference lines 8*e*, 8*f*, which are two thick lines, can be seen though the image 8*a* can not be seen with interruption of the holder 4 inserted into the mounting hole 218. The reference lines 235*a*, 235*b* are provided on the second slide member 213, so that the amount of deviation of the draft sheet 8 and the mounting hole 218 can be confirmed at a glance.

The reference line 235*b* of the second slide member 213 is matched to the reference line 8*f* of the draft sheet 8 by slightly moving the first slide member 212 in the longitudinal direction (the X direction in FIG. 21) of the draft sheet 8 against the outer frame 211 by turning the knob 226. Next, the reference line 235*a* of the second slide member 213 corresponds to the reference line 8*e* by slightly moving the second slide member 213 in the lateral direction (the Y direction in FIG. 21) of the draft sheet 8 against the first slide member 212 by turning the knob 231. The holder 4 and the image 8*a* on the draft sheet 8 are positioned at the center of the mounting hole 218 to be inserted, by turning the knobs 226, 231. At the time, because the convex lenses 236 are formed on the reference lines 235*a*, 235*b* of the second slide member 213, the portions where the reference lines 8*e*, 8*f* matching to the reference lines 235*a*, 235*b*, respectively, are magnified. Therefore, positioning can be easily performed.

When the covers 134, 135 of the stamp making portion 106 (refer to FIG. 7) are closed after positioning the mounting hole 218 of the attachment 201, a predetermined pressure acts on the stamp material 3 inserted into the mounting hole 218 of the attachment 201, via the holder 4, as shown in FIG. 8. Then, as described above, the irradiation unit 120 in the stamp making apparatus 100 is operated and a stamp plate corresponding to the image 8*a* on the draft sheet 8 is formed on the stamp material 3.

Figure 30:
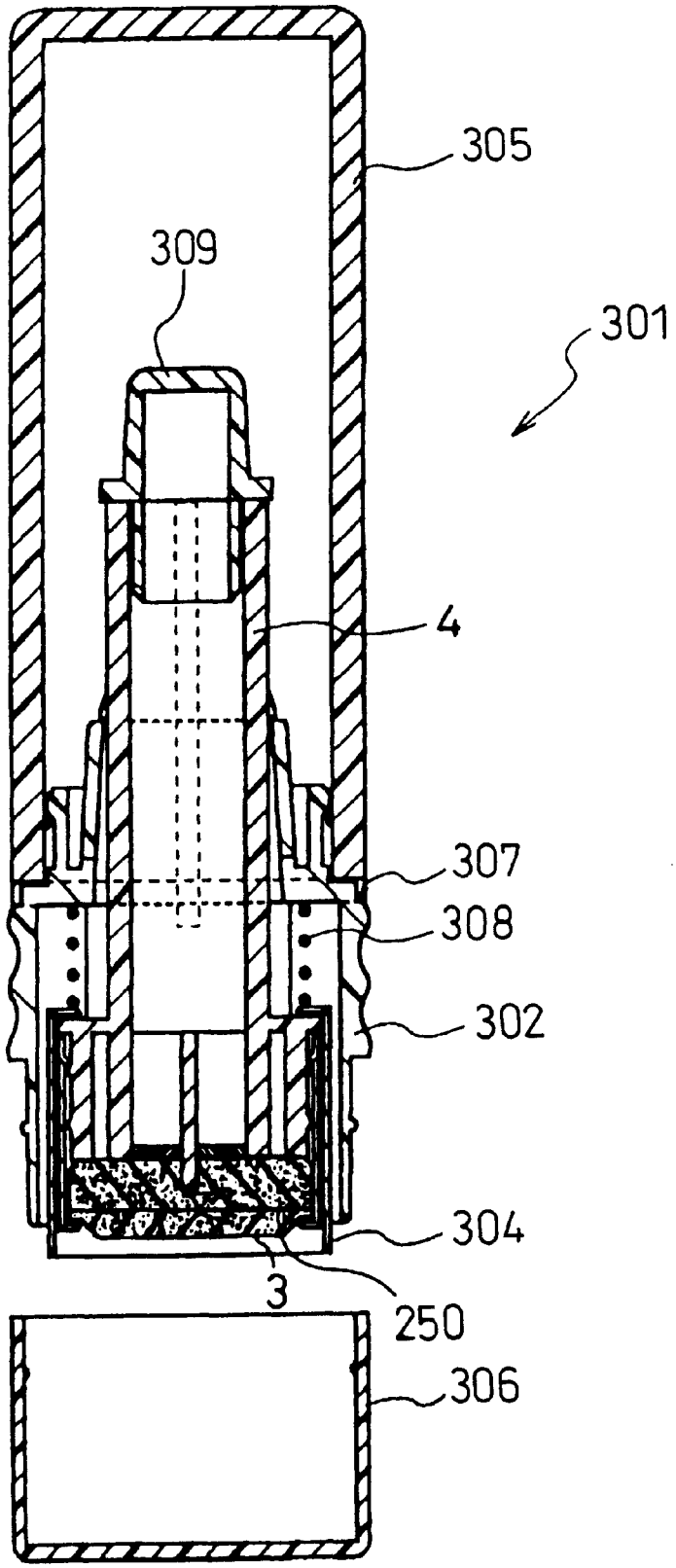
FIG. 30 is a sectional view of a micro stamp.

The stamp material 3 and the holder 4 made by the aforementioned method are installed in a cylindrical shaped stamp 301 as shown in FIG. 30. The stamp 301 comprises the holder 4, a sub holder 302, a skirt member 304, a grip member 205, a cover 306, a ring 307, and a cap 309. The holder 4 holds the stamp material 3 and the ink absorber 250 at the lower end portion thereof. The sub holder 302 is a finger grip portion and supports the stamp 301. The skirt member 304 is made of a stainless and can slide in an axial direction against the holder 4 disposed within the sub holder 302. The grip member 305, which is made of a polybuthylene terephthalate (hereinafter referred to as PBT) resin, has a cylindrical shape and the upper portion of the grip member 305 is closed. The grip member 305, which is joined to the holder 4, moves the holder 4 downward when printing, and presses the stamp material 3 against a printing sheet (not shown). The cover 306 is made of PBT and covers the stamp material 3 to protect its surface. The ring 307 is made of an aluminum material for ornamental purpose and is disposed between the sub holder 302 and the grip member 305. The cap 309 is detachably attached to the holder 4.

The first adjusting device 222 and the second adjusting device 223 shown in FIG. 21 are not limited to have the springs 224, 229 disposed at one side of the moving direction, the eccentric cams 225, 230 disposed at other side of the moving direction, and the knobs 226, 231 rotating the eccentric cams 225, 230. If the first adjusting device 222 and the second adjusting device 223 have a mechanism capable of positioning with respect to two-dimensions (X,Y), various modifications and alterations can be made thereto without departing from the scope of the invention. However, at least one of the first adjusting device 222 and the second adjusting device 223 is preferable to have a simple structure such as having the springs 224, 229, the eccentric cams 225, 230, and the knobs 226, 231.

Further, the second slide member 213 is preferable to be entirely transparent. However, it may be made of a non-transparent material, and the image 8*a* on the draft sheet 8 may be positioned through the mounting hole 218 with the holder 4 detached.

What is claimed is:

1. A stamp making apparatus for making a pattern on a stamp material by applying an energy thereto, comprising:

a stamp holder that holds the stamp material at a lower end portion thereof;

an energy applying unit that applies an energy to the stamp material, the energy applying unit including an energy source; and an attachment detachably attached to the energy applying unit, the attachment defining a plurality positioning portions for receiving a plurality of stamp holders, each positioning portion adapted to detachably receive one of the plurality of stamp holders, and the positioning portions positioning the stamp holder for the stamp material to face the energy source, wherein the positioning portions define an opening which penetrates the attachment.

2. The stamp making apparatus according to claim 1, wherein the energy applying unit comprises an irradiation unit that applies light energy to the stamp material, the irradiation unit including a light source.

3. The stamp making apparatus according to claim 2, further comprising a transparent draft sheet having an image on a transparent material, which is disposed between the light source and the attachment.

4. The stamp making apparatus according to claim 3, wherein the attachment includes an adhesive member at a bottom surface thereof, which adheres the transparent draft sheet to the attachment.

5. The stamp making apparatus according to claim 2, wherein the attachment further includes a transparent supporting sheet which is attached to a bottom surface of the attachment.

6. The stamp making apparatus according to claim 1, further comprising a detecting device that detects a type of the attachment.

7. The stamp making apparatus according to claim 6, wherein the attachment includes a distinguishing portion detectable by the detecting device.

8. The stamp making apparatus according to claim 6, further comprising an energy controller that controls the energy applying unit based on a type of the attachment detected by the detecting device.

9. The stamp making apparatus according to claim 1, further comprising an auxiliary member detachably inserted into the positioning portion of the attachment, the auxiliary member defining an opening into which the stamp holder is inserted.

10. The stamp making apparatus according to claim 1, further comprising a fine adjustment device that adjusts a position of the attachment relative to the energy applying unit in a horizontal direction.

11. The stamp making apparatus according to claim 10, further comprising a transparent draft sheet having an image on a transparent material, which is disposed between the light source and the attachment.

12. The stamp making apparatus according to claim 11, further comprising a feeding mechanism that feeds the transparent draft sheet to between the light source and the attachment, wherein the fine adjustment device comprises a feeding direction moving device that moves the attachment in a feeding direction of the transparent draft sheet.

13. The stamp making apparatus according to claim 12, further comprising a lateral direction moving device that moves the attachment in a lateral direction perpendicular to the feeding direction of the transparent draft sheet.

14. The stamp making apparatus according to claim 10, wherein the fine adjustment device comprises a first moving device that moves the attachment in a first horizontal direction.

15. The stamp making apparatus according to claim 14, wherein the fine adjustment device further comprises a second moving device that moves the attachment in a second horzontal direction perpendicular to the first horizontal direction.

16. The stamp making apparatus according to claim 10, wherein the fine adjusting device comprises:

an outer frame;

a first slide member disposed in the outer frame, the first slide member sliding in a first horizontal direction;

a second slide member disposed in the first slide member, the second slide member sliding in a second horizontal direction;

a first adjustment device that adjusts a position of the first slide member relative to the outer frame; and a second adjustment device that adjusts a position of the second slide member relative to the first slide member.

17. The stamp making apparatus according to claim 16, wherein the first adjusting device comprises:

a first spring disposed on an end of the first slide member in a sliding direction thereof;

a first cam disposed on the other end of the first slide member in the sliding direction thereof; and a first finger grip member connected to the cam.

18. The stamp making apparatus according to claim 17, wherein the second adjusting device comprises:

a second spring disposed on an end of the second slide member in a sliding direction thereof;

a second cam disposed on the other end of the second slide member in the sliding direction thereof; and a second finger grip member connected to the cam.

19. The stamp making apparatus according to claim 1, wherein a peripheral part around the positioning portion of the attachment is made of a transparent material.

20. The stamp making apparatus according to claim 19, wherein the peripheral part around the positioning portion of the attachment has a positioning mark thereon.

21. The stamp making apparatus according to claim 20, wherein a part of the attachment having the positioning mark thereon is formed into a convex lens.

22. The stamp making apparatus according to claim 21, wherein the attachment has a fixing portion for fixing the transparent supporting sheet, the fixing portion is formed to be asymmetrical about a center line thereof.

23. An attachment used in a stamp making apparatus for making a pattern on a stamp material by applying an energy thereto, the stamp making apparatus including a stamp holder that holds the stamp material at a lower end portion thereof and an energy applying unit that includes an energy source, wherein the attachment is detachably attached to the energy applying unit, the attachment defines a plurality of positioning portions for receiving a plurality of stamp holders, each positioning portion adapted to detachably receive one of the plurality of stamp holders, and the positioning portions positioning the stamp holder for the stamp material to face the energy source, wherein the positioning portions define an opening which penetrates the attachment.

24. The attachment according to claim 23, wherein the attachment includes a distinguishing portion detectable by the stamp making apparatus.

25. The attachment according to claim 23, further comprising an auxiliary member detachably inserted into the positioning portion of the attachment, the auxiliary member defining an opening into which the stamp holder is inserted.

26. The attachment according to claim 23, further comprising a fine adjustment device that adjusts a position of the positioning portion relative to the energy applying unit in a horizontal direction.

27. The attachment according to claim 26, wherein the fine adjustment device comprises a first moving device that moves the attachment in a first horizontal direction.

28. The attachment according to claim 27, wherein the fine adjustment device further comprises a second moving device that moves the attachment in a second horizontal direction perpendicular to the first horizontal direction.

29. The attachment according to claim 26, wherein the fine adjustment device comprises:

an outer frame;

a first slide member disposed in the outer frame, the first slide member sliding in a first horizontal direction;

a second slide member disposed in the first slide member, the second slide member sliding in a second horizontal direction;

a first adjustment device that adjusts a position of the first slide member relative to the outer frame; and a second adjustment device that adjusts a position of the second slide member relative to the first slide member.

30. The attachment according to claim 29, wherein the first adjustment device comprises:

a first spring disposed on an end of the first slide member in a sliding direction thereof;

a first cam disposed on the other end of the first slide member in the sliding direction thereof; and a first finger grip member connected to the cam.

31. The attachment according to claim 30, wherein the second adjustment device comprises:

a second spring disposed on an end of the second slide member in a sliding direction thereof;

a second cam disposed on the other end of the second slide member in the sliding direction thereof; and a second finger grip member connected to the cam.

32. The attachment according to claim 23, wherein a peripheral part around the positioning portion of the attachment is made of a transparent material.

33. The attachment according to claim 32, wherein the peripheral part around the positioning portion of the attachment has a positioning mark thereon.

34. The attachment according to claim 33, wherein a part of the attachment having the positioning mark thereon is formed into a convex lens.

35. A stamp making apparatus for making a pattern on a stamp material by applying an energy thereto, the stamp material being held by a stamp holder at a lower end portion thereof, comprising:

an energy applying unit that applies an energy to the stamp material, the energy applying unit including an energy source; and an attachment detachably attached to the energy applying unit, the attachment defining a plurality of positioning portions for receiving a plurality of stamp holders, each positioning portion adapted to detachably receive one of the plurality of stamp holders and the positioning portions positioning the stamp holder for the stamp material to face the energy source.

* * * * *